US008209937B2

(12) United States Patent
Scheps

(10) Patent No.: US 8,209,937 B2
(45) **Date of Patent: *Jul. 3, 2012**

(54) RETRACTABLE ENCLOSURE

(75) Inventor: Richard Anthony Scheps, Sharon (CA)

(73) Assignee: Richard Anthony Scheps, Sharon (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/277,277

(22) Filed: Oct. 20, 2011

(65) Prior Publication Data

US 2012/0031013 A1 Feb. 9, 2012

Related U.S. Application Data

(63) Continuation of application No. 12/136,405, filed on Jun. 10, 2008, now Pat. No. 8,136,306.

(51) Int. Cl.
*E04B 1/346* (2006.01)
*E04B 7/16* (2006.01)

(52) U.S. Cl. ..... 52/747.1; 52/67; 52/66; 52/72; 52/64

(58) Field of Classification Search ..... 52/6, 79.5, 52/64, 66, 67, 72, 745.05; 160/202; 384/15; 74/608

See application file for complete search history.

(56) References Cited

U.S. PATENT DOCUMENTS

| | | | | |
|---|---|---|---|---|
| 1,456,478 | A | 5/1923 | White | |
| 1,896,433 | A | 2/1933 | Windeknecht | |
| 3,578,061 | A | 5/1971 | Hascheck et al. | |
| 3,766,691 | A | 10/1973 | Ray | |
| 3,845,591 | A | 11/1974 | Stine | |
| 4,103,462 | A | 8/1978 | Freller | |
| 4,175,361 | A | 11/1979 | Kumode | |
| 4,277,919 | A | 7/1981 | Artweger et al. | |
| 4,288,949 | A | 9/1981 | Latimer | |
| 4,711,257 | A | 12/1987 | Kobayashi | |
| 4,783,861 | A | 11/1988 | Leurent | |
| 5,035,093 | A | 7/1991 | Parazader et al. | |
| 5,156,195 | A | 10/1992 | Wehler et al. | |
| 5,201,152 | A | 4/1993 | Heffner | |
| 5,257,481 | A | 11/1993 | Reppas et al. | |
| 5,373,668 | A | 12/1994 | Shulman et al. | |
| 5,373,679 | A | 12/1994 | Goleby | |
| 5,622,013 | A | 4/1997 | Ban et al. | |
| 5,907,928 | A | 6/1999 | Charbonnel | |
| 5,996,666 | A | 12/1999 | Denina | |
| 6,170,209 | B1 | 1/2001 | Dagher et al. | |
| 6,430,879 | B1 | 8/2002 | Nuiry et al. | |
| 6,604,327 | B1 | 8/2003 | Reville | |
| 6,637,160 | B2 | 10/2003 | Brooks | |
| 6,952,900 | B2 | 10/2005 | Leurent | |
| 7,562,413 | B2 | 7/2009 | Martin et al. | |
| 7,891,031 | B2 | 2/2011 | Khalaf et al. | |
| 8,136,306 | B2 * | 3/2012 | Scheps | 52/67 |
| 2003/0000154 | A1 | 1/2003 | Ignazio | |

(Continued)

*Primary Examiner* — Mark Wendell
(74) *Attorney, Agent, or Firm* — Bereskin & Parr LLP/S.E.N.C.R.L., s.r.l.

(57) ABSTRACT

A retractable enclosure includes moveable bays that telescopically retract inside each other. Each bay is made from two or more vertical framing sections and a plurality of first framing members. Each vertical framing section can be made from a plurality of second framing members. Assembly rods are provided to couple the vertical framing sections and are tensioned to load the first framing members in longitudinal compression. The framing members are fastenable to each other. The second framing members can be held together using splice plates. The retractable enclosure may also include a drive system. A related method of constructing a retractable enclosure is also provided.

22 Claims, 17 Drawing Sheets

U.S. PATENT DOCUMENTS

2003/0145882 A1 8/2003 Sanna
2004/0187397 A1 9/2004 Chapus
2006/0254160 A1 11/2006 Lee
2007/0144078 A1 6/2007 Frondelius

* cited by examiner

RETRACTABLE ENCLOSURE

CROSS REFERENCE TO RELATED APPLICATION

This application is a continuation application of U.S. application Ser. No. 12/136,405 filed Jun. 10, 2008, which is hereby incorporated herein by reference in its entirety.

FIELD

The teaching disclosed herein relates to retractable enclosures, and to systems and methods for constructing retractable enclosures, as well as systems and methods for retracting and extending retractable enclosures.

BACKGROUND

The following paragraphs are not an admission that anything discussed in them is prior art or part of the knowledge of persons skilled in the art.

U.S. Pat. No. 6,604,327 (Reville) discloses a retractable trackless spa enclosure including at least two sections, a first section being slightly smaller than a second section.

U.S. Pat. No. 4,175,361 (Kumode) discloses an openable canopy housing having a series of movable, telescoping, transparent and arched panels which form the combination roof and sides.

U.S. Pat. No. 6,637,160 (Brooks) discloses a plurality of movable transparent arcuate sections that can roll on their own designated tracks to enclose or expose a sun room or pool area.

U.S. Pat. No. 5,907,928 (Charbonnel) discloses a removable protective shelter.

U.S. Pat. No. 5,373,668 (Shulman) discloses a cottage with a rear framed section that is adjacent to a front framed section, wherein the cottage functions to position the roof completely over the rear framed section or the front framed section, and in positions therebetween.

U.S. Patent Publication No. 20060254160 (Lee) discloses a telescopic shelter system comprising two pairs of guide rails having a pair of parallel outer rails and a pair of parallel inner rails arranged at an inner side of the outer rails, a plural of shelters comprising two side walls facing each other and a roof connecting at the top of the two side walls.

SUMMARY

The following summary is intended to introduce the reader to this specification but not to define any invention.

In general, this specification discusses one or more systems or methods related to retractable enclosures.

In some examples, a retractable enclosure comprising two or more bays can be configured to telescopically overlap when in a retracted position, each of the two or more bays including: at least a first vertical framing section and a second vertical framing section; a plurality of first framing members disposed between the first vertical framing section and the second vertical framing section to space apart the first vertical framing section from the second vertical framing section; and a plurality of assembly rods coupling the first vertical framing section with the second vertical framing section and tensioned to load the plurality of first framing members in longitudinal compression.

The first framing members can be generally horizontal and can have a generally uniform longitudinal cross-section, and can comprise an extruded product. The first framing members can comprise one or more first sidewalls, and can comprise longitudinal channels for retaining the assembly rods. The longitudinal channels can be disposed along an interior surface of the one or more first sidewalls. The longitudinal channels can be defined by generally opposing finger elements.

The first vertical framing section and the second vertical framing section can include apertures for receiving ends of the assembly rods. Clamping elements can be coupled to at least one end of each of the assembly rods to engage the first vertical frame section and exert force urging the first vertical frame section toward the second vertical frame section. The clamping elements can be adjustable. At least one end of each of the assembly rods can be threaded, and the clamping elements can be nuts.

The vertical framing sections can comprise a plurality of second framing members. The second framing members can have a second generally uniform longitudinal cross-section, and can comprise a second extruded product. Adjacent second framing members in each vertical framing section can be coupled by splice plates, with the second framing members including slots at each end for receiving the splice plates. The splice plates can be secured within the slots using wedges.

The retractable enclosure can further comprise tracks supporting at least one of the two or more bays and enabling movement between the retracted position and an extended position. At least one of the two or more bays can be movably connected to the tracks by wheels. The retractable enclosure can further comprise a plurality of panels enclosing space within each bay.

The retractable enclosure can further comprise a drive system for moving at least one of the two or more bays between the retracted and extended positions. Tracks can support the at least one of the two or more bays, wherein the drive system is configured to move the first bay along the tracks between the retracted and extended positions. The drive system can comprise: a motor assembly including a motor and a drive pulley, the drive pulley provided proximate to a first position on the tracks; at least one return pulley provided proximate to a second position on the tracks spaced apart from the first position; and a cable linking the drive and return pulleys, the cable coupled to the at least one of the two or more bays, wherein operation of the motor assembly circulates the cable between the drive and return pulleys causing the at least one of the two or more bays to move along the tracks.

The at least one of the two or more bays can comprise a plurality of wheel assemblies, the wheel assemblies movably connecting the at least one of the two or more bays to the tracks. At least one of the plurality of wheel assemblies can be coupled to the cable. The tracks can comprise a longitudinal channel for housing the cable. A plurality of engagement elements can be secured spaced apart along the cable, and the drive pulley can comprise a sprocket drive pulley having a plurality of recesses spaced around its circumference, the recesses configured to receive the engagement elements.

In some examples, a retractable enclosure comprises: at least a first bay and a second bay, the first and second bays configured to move between retracted and extended positions, the first and second bays telescopically overlapping when in the retracted position; tracks supporting the first bay and enabling movement of the first bay between the retracted and extended positions; and a drive system for moving the first bay along the tracks between the retracted and extended positions.

The drive system can comprise: a motor assembly including a motor and a drive pulley, the drive pulley provided proximate to a first position on the tracks; at least one return pulley provided proximate to a second position on the tracks spaced apart from the first position; and a cable linking the drive and return pulleys, the cable coupled to the first bay, wherein operation of the motor assembly circulates the cable between the drive and return pulleys causing the first bay to move along the tracks.

The first bay can comprise a plurality of wheel assemblies, the wheel assemblies movably connecting the first bay to the tracks. At least one of the plurality of wheel assemblies can be coupled to the cable. The tracks can comprise a longitudinal channel for housing the cable. A plurality of engagement elements can be secured spaced apart along the cable, and the drive pulley can comprise a sprocket drive pulley having a plurality of recesses spaced around its circumference, the recesses configured to receive the engagement elements.

Each of the two or more bays can comprise: at least a first vertical framing section and a second vertical framing section; a plurality of first framing members disposed between the first vertical framing section and the second vertical framing section to maintain a horizontally spaced apart relationship; and a plurality of assembly rods connecting the first vertical framing section and the second vertical framing section and tensioned to load the plurality of first framing members in longitudinal compression.

In some examples, a method of constructing a retractable enclosure comprises constructing a bay including the steps of: placing a plurality of framing members between a first vertical framing section and a second vertical framing section so that the vertical framing sections maintain a spaced apart relationship; connecting the first vertical framing section to the second vertical framing section with a plurality of assembly rods; and tensioning the plurality of assembly rod to load the plurality of framing members in longitudinal compression. The step of constructing can be repeated to form two or more bays, wherein the two or more bays are configured to telescopically overlap when in a retracted position.

The method can further comprise placing at least one of the two or more bays on parallel tracks enabling movement between the retracted position and an extended position. The method can also comprise inserting panels to enclose space within each of the two or more bays.

Other aspects and features of the present specification will become apparent, to those ordinarily skilled in the art, upon review of the following description of the specific examples of the specification.

BRIEF DESCRIPTION OF THE DRAWINGS

The drawings included herewith are for illustrating various examples of articles, systems, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicant(s), inventor(s) and/or owner(s) reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
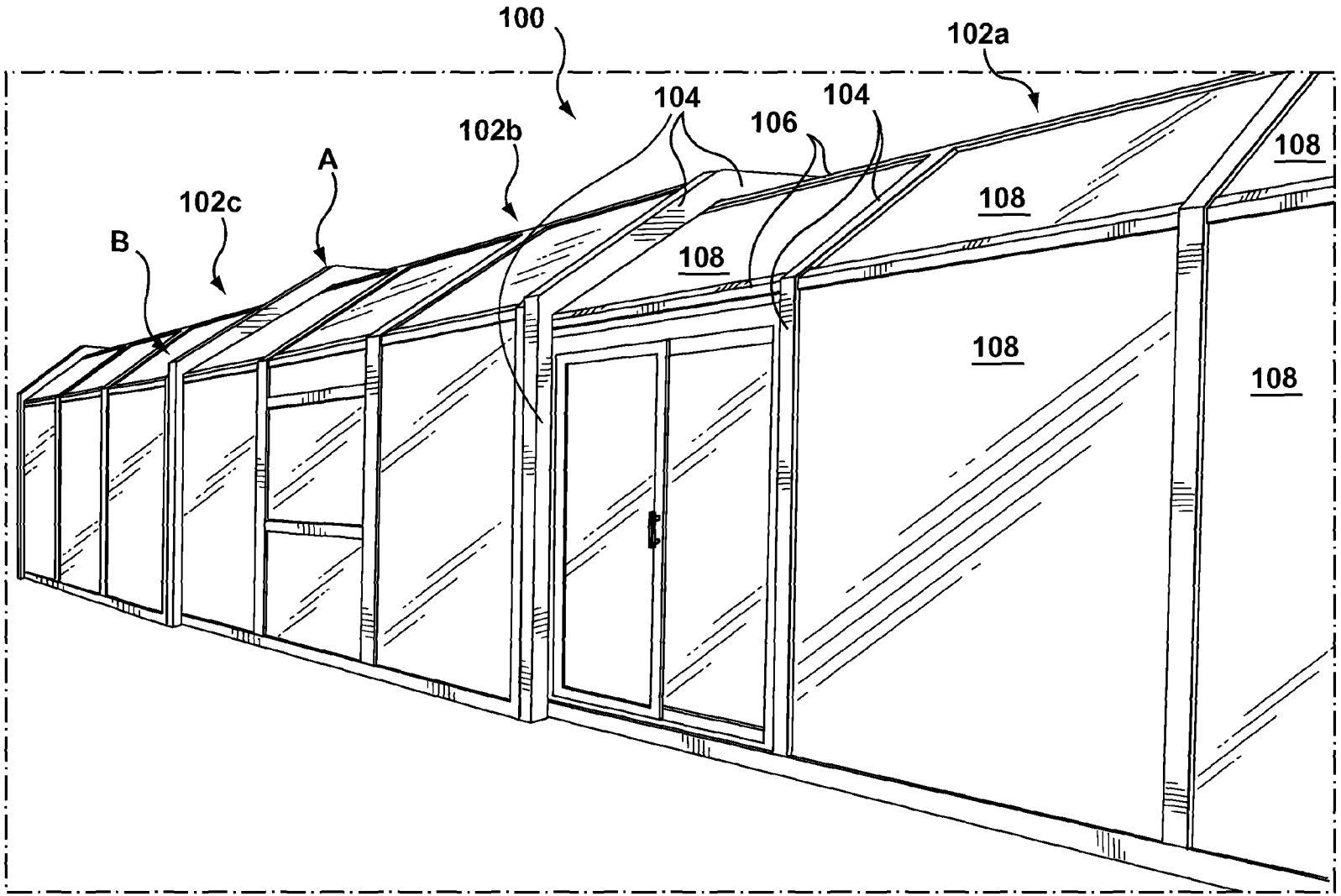
FIG. 1 is a perspective view of a retractable enclosure including a plurality of bays formed from framing members.

Referring to FIG. 1, illustrated therein is a retractable enclosure 100 including a plurality of framework sections called bays 102, some of which can telescopically retract with respect to one another. In the example illustrated, the retractable enclosure 100 has three bays 102*a*, 102*b*, and 102*c*. The first bay 102*a* is sized to fit within the second bay 102*b*, and the second bay 102*b* is sized to fit within the third bay 102*c*. In the example illustrated, the first and second bays 102*a*, 102*b* are moveable, and the third bay 102*c* does not move and may be affixed to the ground. In other examples, the third bay 102*c* may be moveable. The first bay 102*a* may also be referred to as an end bay 102*a*. Generally, the end bays 102*a*, 102*c* include an end wall (not shown) that closes off the outer end of the retractable enclosure 100.

Each bay 102 may be built from a plurality of framing members. In the example illustrated, each bay 102 comprises two or more vertical framing sections and a plurality of first framing members 106 that interconnect the vertical framing sections. In the example illustrated, each vertical framing section comprises a plurality of second framing members 104. Other embodiments are possible. For example, each vertical framing section can consist of a single U-shaped framing member.

Figure 2:
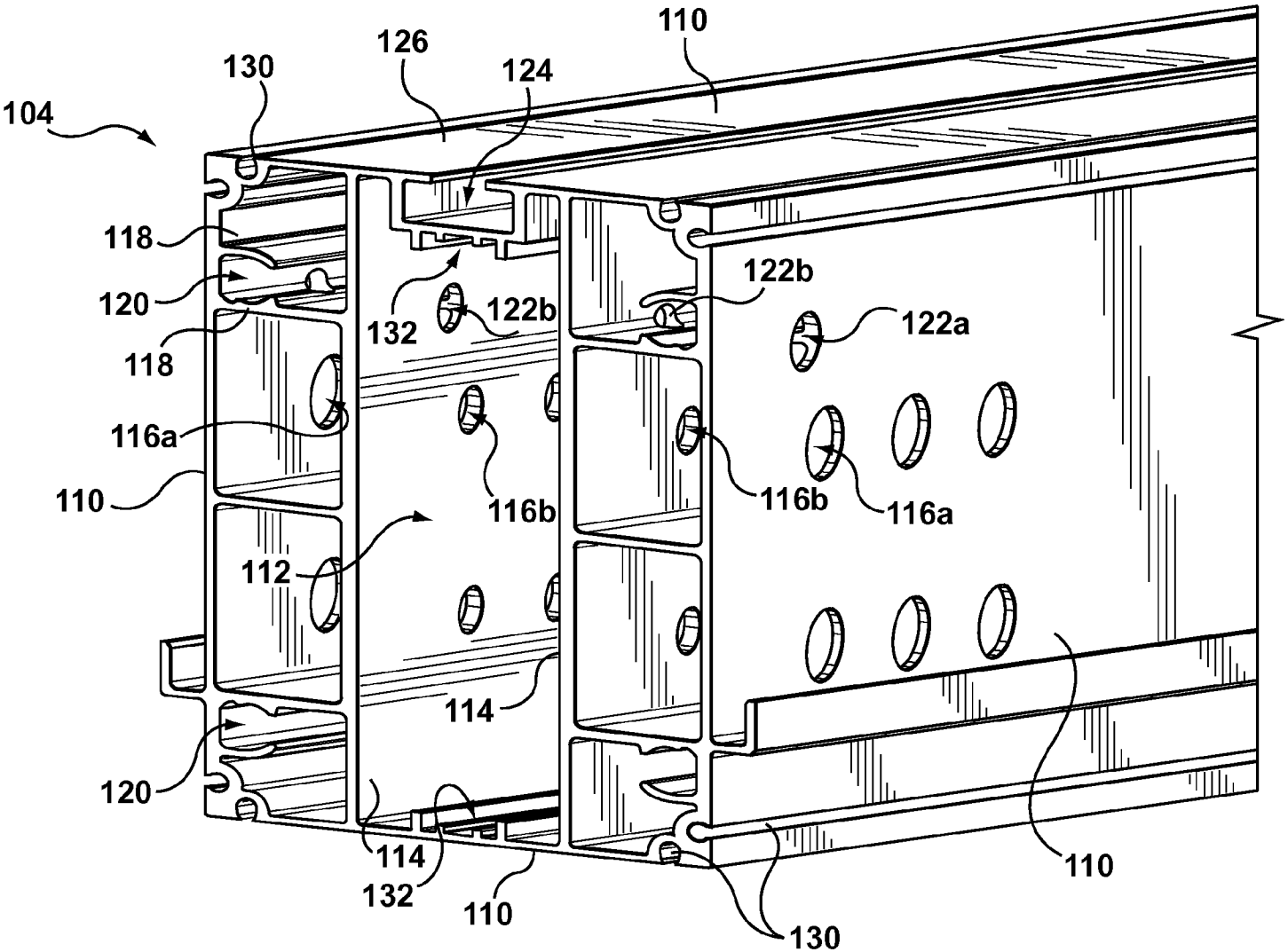
FIG. 2 is a perspective view of a cross-section of one of the framing members of FIG. 1, referred to herein as a second framing member.
Figure 3:
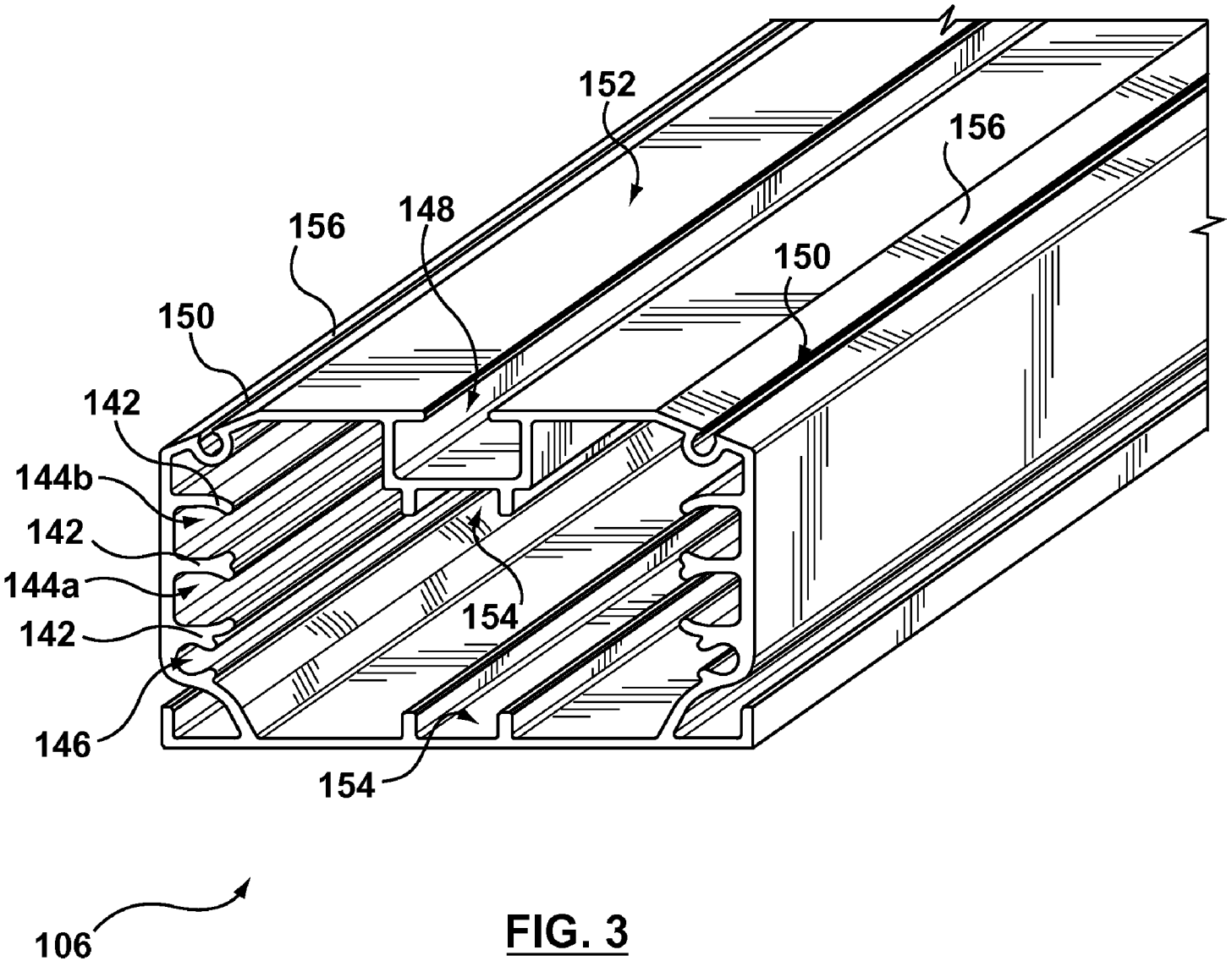
FIG. 3 is a perspective view of a cross-section of another of the framing members of FIG. 1, referred to herein as a first framing member.

The second framing members 104 and first framing members 106 can be elongate structural members that form the overall frame of each bay. The second framing members 104 and first framing members 106 may be made from rigid structural materials, for example aluminium or steel. The second framing members 104 and first framing members 106 may be formed by extrusion and have a constant cross-sectional shape. As illustrated in FIGS. 2 and 3, the cross-sectional shape of the second framing members 104 and first framing members 106 may be symmetrical about planes bisecting the respective members.

The second framing members 104 can be configured to facilitate fastening the second framing members to one or more other second framing members 104 and/or to one or more first framing members 106. The first framing members 106 can be fastenable between pairs of second framing members 104. In some embodiments, the second framing members 104 may be the main structural members of each bay 102, for example the second framing members 104 may form the overall frame of the bay including the horizontal base, vertical sidewalls and roof. In these examples, the first framing members 106 may interconnect the second framing members 104 horizontally, vertically, or diagonally. Such interconnection may space the second framing members apart from one another or may improve the overall rigidity of the bay 102. In some examples, the framing members of each bay may consist only of second framing members 104 and first framing members 106.

The assembled framing members 104, 106 can be configured in one or more grids or networks defining openings bounded by adjacent members 104, 106. Panels 108 can be mounted in the openings to cover some or all of the space within/underneath the retractable enclosure 100. The panels 108 may be thin, rigid plates made of a transparent or translucent material, such a glass, polycarbonate, or a similar material. In some examples, doors or windows may be used as panels.

As will be described in further detail below, the second framing members 104 and first framing members 106 can facilitate construction of modular retractable enclosures. The modular retractable enclosures can be customised to a variety of shapes and sizes.

Referring to FIG. 2, each second framing member 104 includes exterior sidewalls 110 that form a generally rectangular cross-section having a hollow interior. The second framing member 104 has a slot 112 formed between two internal sidewalls 114 that are parallel and laterally spaced apart within the hollow interior. Generally, the slot 112 extends the length of the second framing member 104 and typically has a rectangular cross-section, although other examples may have slots with different cross-sectional shapes. The internal sidewalls 114 may also provide structural integrity for the second framing member 104.

The second framing member 104 has at least one aperture through the exterior sidewalls 110. In some examples, the second framing member 104 may include a plurality of first aligned apertures 116*a*, 116*b* on the exterior sidewalls 110 and the interior sidewalls 114 respectively. As illustrated, the outside aperture 116*a* may be larger than inside aperture 116*b* such that the head of a bolt (or similar fastener) fits through the outside aperture 116*a*, but not through the inside aperture 116*b*. The second framing member may also include a plurality of second aligned apertures 122*a*, 122*b* on the exterior sidewalls 110 and interior sidewalls 114 that allow insertion of assembly rods laterally. The second aligned apertures 122*a*, 122*b* are generally the same size as each other, which may be slightly larger than the diameter of the assembly rod.

Each of the interior corners of the hollow interior may include fingers 118 that form longitudinal grooves 120 for receiving assembly rods longitudinally (the assembly rods will be discussed in further detail below).

In some examples, the second framing member 104 may also have a notch 124 extending longitudinally along an exterior surface of the second framing member 104, for example a top surface 126. The notch 124 may be configured to allow attachment of snaps caps 128 (see FIGS. 4 to 7). The snap caps can, in some examples, help to funnel water away from the second framing member, and/or can provide aesthetic appeal. Typically, the notch 124 is rectangular in cross-section and is recessed below the exterior sidewall 110 such that a portion of the sidewall overhangs the notch 124. The overhanging portion may secure the snap caps 128 to the second framing member 104.

Each outer corner of the second framing member 104 may also have slits 130 along the exterior surface of the exterior sidewalls 110. The slits may receive rubber gaskets for sealing the panels 108 between the snap caps 128 and the second framing member 104.

The hollow interior of second framing member 104 may also include a pair of channels 132, for example located on the interior surface of the top and bottom exterior sidewalls 110. The channels 132 align to form a generally rectangular slot that allows the insertion of a gusset plate along the length of the second framing member 104. The gusset plate may stiffen the second framing member and may provide additional rigidity to the retractable enclosure 100. In these examples, the slot 112 may be located on either or both lateral sides of the channels 132.

Referring to FIG. 3, each of the first framing members 106 includes exterior sidewalls 140 that form a generally rectangular cross section having a hollow interior. The interior surface of the sidewalls 140 may include fingers 142 that protrude inwardly from the exterior sidewalls 140 and into the hollow interior. Adjacent fingers 142 are shaped to form grooves 144*a*, 144*b* that extend along the length of the first framing member 106. As illustrated, there are three fingers 142 located on the interior surfaces of the laterally opposing sidewalls 140. The three fingers cooperate to form a first groove 144*a* and a second groove 144*b*. Generally, the grooves 144*a*, 144*b* have a cylindrical shape. In some examples, the grooves 144*a*, 144*b* may have different shapes, for example square or hexagonal. As illustrated, the fingers 142 may have ends that curl inwards towards the ends of other adjacent fingers. As illustrated, the ends may be set apart from the ends of adjacent fingers, or in other examples, the ends may be joined together. The grooves 144*a*, 144*b* are generally configured to receive assembly rods for fastening the first framing member 106 to the second framing members 104, as will be described in further detail below.

In some examples, the first framing members 104 may include a third groove 146 formed into the sidewall and within the hollow interior. In the example illustrated, the third groove 146 is different than the first and second grooves 144*a*, 144*b*. Generally, the third groove 146 is sized and configured to receive self-tapping screw for fastening the first framing member 106 to the second framing members 104 as opposed to an assembly rod. In particular, the third groove 146 may have a smaller diameter than the first and second grooves 144*a*, 144*b*.

Similar to the second framing members 104, each first framing member 106 may have a notch 148 and slits 150 on the exterior surface of the sidewalls 140, for example the top surface 152. The notch 148 and the slits 150 generally accommodate snap caps 128 and rubber seals. Furthermore, the top surface 152 may include a bevelled edge 156, which allows attachment of different types of snap caps 76. For example, the first framing member may use a different snap cap at points where there is a change in roof pitch of the retractable enclosure 100 (point A in FIG. 1), or where the top edge of a sidewall meets the roof of the retractable enclosure 100 (point B in FIG. 1). In these examples, the different snap caps have peaks with different angles that allow the sealing of the panels 108 which extend from the first framing members at different angles, for example depending on whether the joint is at a change in roof pitch, or the joint is between a sidewall and the roof of the retractable enclosure. Also similar to the second framing members, each first framing member 106 may include channels 154 for receiving a gusset plate.

Referring to FIGS. 4 to 7, a joint is provided between two second framing members 104*a*, 104*b* and a first framing member 106 at a point where the roof changes pitch (point A in FIG. 1).

Figure 5:
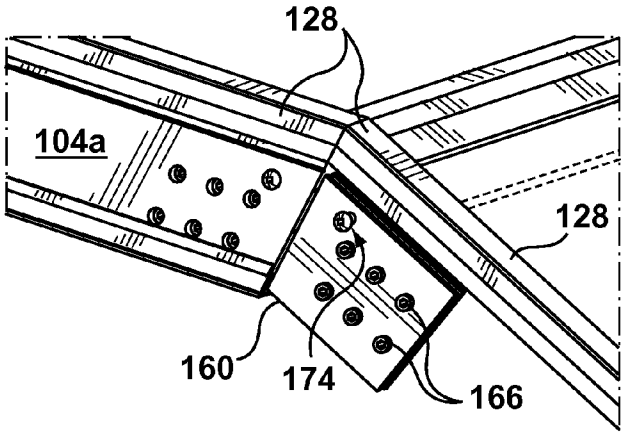
FIG. 5 is a perspective view of the joint shown in FIG. 4, wherein one of the second framing members is removed to expose a splice plate.
Figure 4:
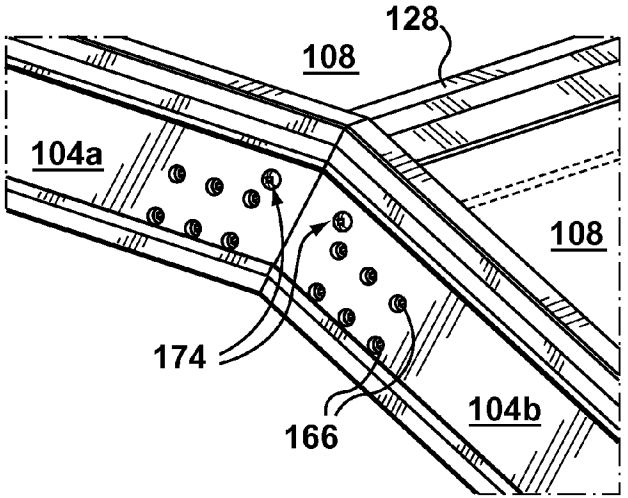
FIG. 4 is a perspective view of a joint between two second framing members and a first framing member, such as the joint illustrated at point A in FIG. 1.
Figure 7:
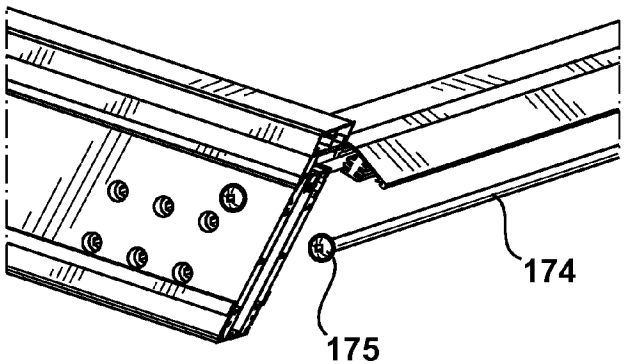
FIG. 7 is a perspective view of the joint shown in FIG. 6, wherein the first framing member is removed to show the assembly rod in further detail.
Figure 6:
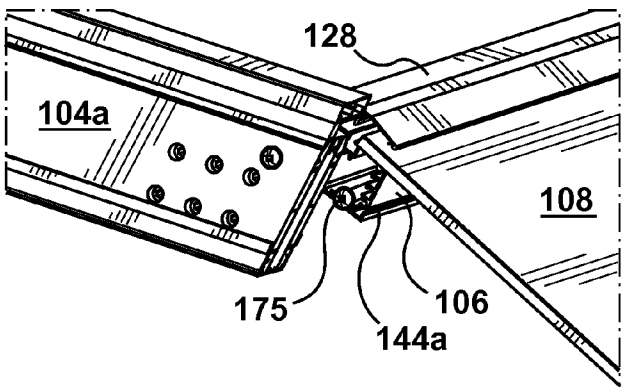
FIG. 6 is a perspective view of the joint shown in FIG. 5, wherein a splice plate is removed to expose the connection of an assembly rod with one of the second framing members and the first framing member.
Figure 10:
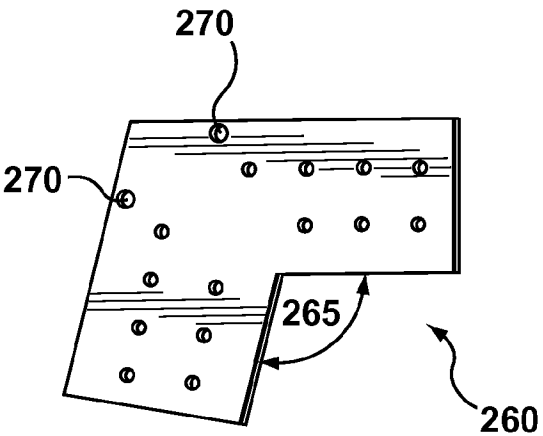
FIG. 10 is a perspective view of a second splice plate.
Figure 9:
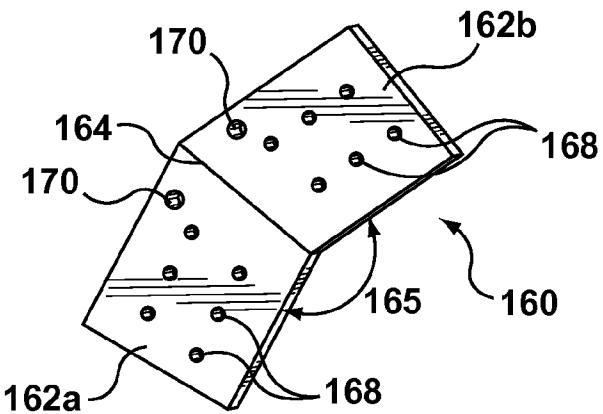
FIG. 9 is a perspective view of a first splice plate.

As shown in FIG. 5, the second framing members 104*a*, 104*b* are joined together using a splice plate 160. As illustrated in FIG. 9, the splice plate 160 is generally a flat plate and includes a first arm 162*a* and a second arm 162*b* joined together along a spine 164. In some examples, the splice plate 160 may be formed of stainless steel. In some examples, the splice plate 160 may include two spaced apart plates. This configuration can allow the insertion of a gusset plate into the channel 132 of the second framing member 104 between the two splice plates. Generally, each arm 162*a*, 162*b* has a trapezoid shape, for example a parallelogram or a rectangle. Generally, the arms 162*a*, 162*b* extend away from the spine 164 to form an angle 165, for example, the angle 165 may correspond to the change in roof pitch of the retractable enclosure 100 as illustrated in FIG. 1 at point A. To accommodate different changes in roof pitch, or other similar joints, there may be several different types of splice plates. For example, as illustrated in FIG. 10, a second splice plate 260 may be used for joining a sidewall to the roof of the retractable enclosure. Each type of splice plate generally has a different angle to allow attachment of the second framing members 104*a*, 104*b* at different angles.

In some examples, the arms 162*a*, 162*b* of the splice plate 160 may be fastened to the second framing members 104*a*, 104*b*, for example using fasteners 166 such as bolts or screws. As illustrated in FIG. 9, splice plate 160 may have first apertures 168 pre-drilled in each of the arms 162*a*, 162*b*. The first apertures 168 being configured for receiving the fasteners 166. The first apertures 168 through each arm of the splice plate 160 are generally configured to align with the first aligned apertures 116*a*, 116*b* of the second framing member 104 when the splice plate 160 is inserted into the slot 112 of the second framing member 104. The splice plate 160 may also have second apertures 170 predrilled in the arms 162*a*, 162*b*. The second apertures being configured for receiving an assembly rod, or another fastener, as will be described in further detail below. The second apertures 170 are generally configured to align with the second aligned apertures 122*a*, 122*b* of the second framing member 104 when the splice plate 160 is inserted into the slot 112 of the second framing member 104.

Figure 8:
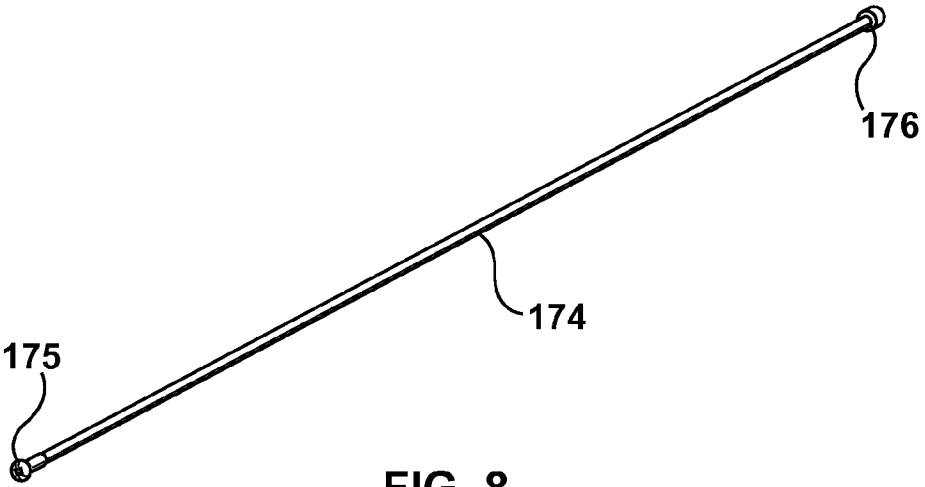
FIG. 8 is a perspective view of an assembly rod.

In the example illustrated in FIGS. 4 to 7, two second framing members 104*a*, 104*b* are fastened to a first framing member 106, for example, using two assembly rods 174. Each assembly rod 174 is generally an elongate cylindrical rod, for example, a threaded rod as shown in FIG. 8. A proximal end of the assembly rod 174 has a head 175 similar to the head of a bolt. The distal end of the assembly rod is insertable through one set of the second aligned apertures 122*a*, 122*b* of one of the second framing members 104*a*, 104*b*, through the apertures 170 of the splice plate 160, and through one of the grooves 144*a*, 144*b* of the first framing member 106. The assembly rod 174 generally extends from a first end to a second end of the first framing member 106. In some examples, the assembly rod 174 may pass through additional elements, or may not pass through some elements. For example the assembly rod 174 may not pass through the splice plate 160.

As illustrated, the first end of the first framing member generally corresponds to a first joint where the second framing members 104*a*, 104*b* fasten to the first framing member 106 together. The second end may correspond to a second joint, for example between a similar pair of second framing members and the first framing member 106. Generally, the distal end of the assembly rod 174 extends past the second joint such that a rod-fastener 176 can be fastened to the distal end. The rod-fastener 176 is generally fastened to the distal end of the assembly rod 174 such that the head 175 of the assembly rod 174 abuts the first joint (i.e. the exterior sidewall of one of the second framing members 104*a*, 104*b*), and such that the rod-fastener similarity abuts the second joint. Furthermore, the rod-fastener 176 is generally tightened on the assembly rod 174 so as to pre-load the assembly rod 174 in tension and pre-load the first framing member 106 in longitudinal compression between the first joint and the second joint. For example, if the assembly rod 174 is threaded, the rod-fastener 176 may be a nut that can be screwed onto the threaded assembly rod 174. Tightening the nut may pre-load the assembly rod 174 in tension and pre-load the first framing member 106 in longitudinal compression. Pre-loading the framing members 104, 106 in this fashion can improve the rigidity of the bay and may improve smooth operation of the bay while being retracted and extended. This can be particularly beneficial when moving the bays in windy environments.

Similarly, a second assembly rod may be inserted through the second aligned apertures 122*a*, 122*b* of the second framing member 104*b* and a corresponding groove on the opposite wall of the first framing member 106.

Figure 11:
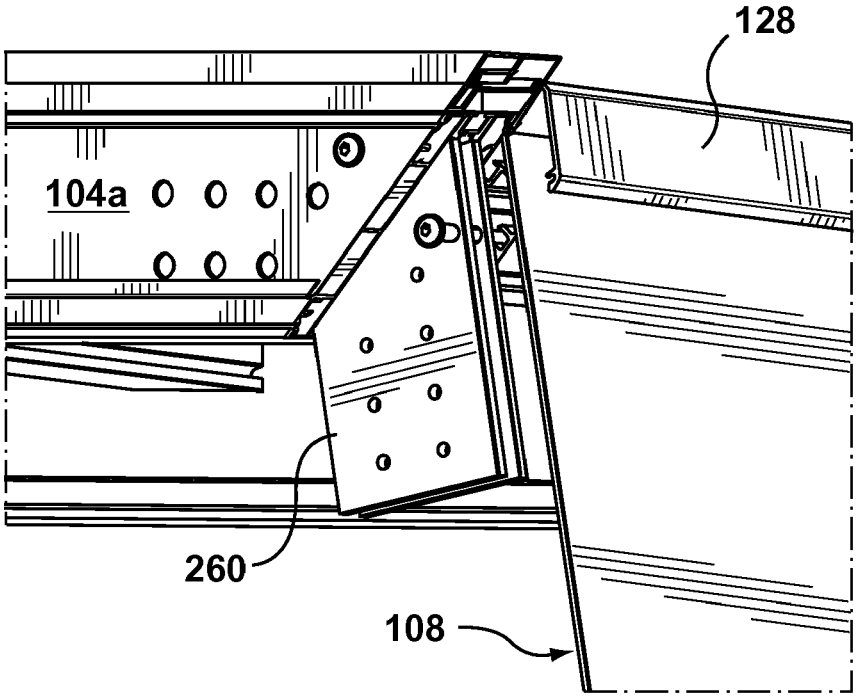
FIG. 11 is a perspective view of the joint illustrated at point B in FIG. 1, wherein one of the second framing members is removed.
Figure 12:
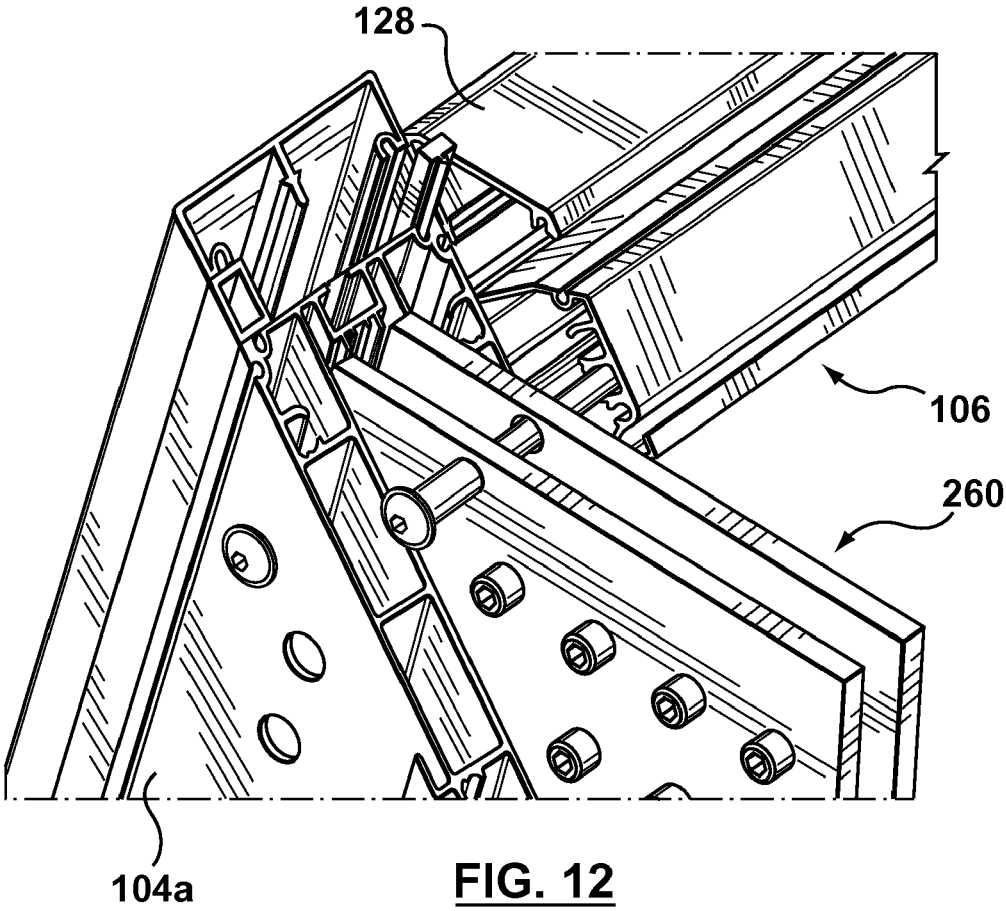
FIG. 12 is another perspective view of the joint shown in FIG. 11.

As mentioned above, two abutting second framing members may be joined together at different angles using different splice plates, for example the first splice plate 160 and second splice plate 260 as shown in FIGS. 9 and 10 respectively. For example, the second framing members may be joined together at a first angle 165 using the first splice plate 160, for example at a point where the roof changes pitch as shown in FIGS. 4 to 7 (point A in FIG. 1). Alternatively, the second framing members may be joined together at a second angle 265 using a second splice plate 260, for example at a point where the sidewall connects to the roof as shown in FIGS. 11 and 12 (point B in FIG. 1).

Depending on the splice plate used to connect the second framing members 104*a*, 104*b*, the assembly rod 174 may be inserted into different grooves 144*a*, 144*b*. Referring to the example shown in FIGS. 4 to 7, if the second framing members 104*a*, 104*b* are joined using the first splice plate 160, the second aligned apertures 122*a*, 122*b* of the first second framing member 104*a* may align with the aperture 170 of the first splice plate 160 and may align with the first groove 144*a* of the first framing member 106. Thus the assembly rod 174 may be inserted through the apertures 122*a*, 122*b*, 170 and through the first groove 144*a*. Alternatively, if the second framing members 104*a*, 104*b* are joined using the second splice plate 260, the second aligned apertures 122*a*, 122*b* of the first second framing member 104*a* may align with the aperture 270 of the second splice plate 260 and may align with the second groove 144*b* of the first framing member 106. Thus the assembly rod 174 may be inserted through the apertures 122*a*, 122*b*, 270 and through the second groove 144*b*. In some examples, such as the one shown in FIGS. 11 and 12, using the second splice plate 260 may still allow use of the first groove 144*a*.

In some examples, the second framing members 104*a*, 104*b*, may be fastened to the first framing member 106 using fasteners other than assembly rods 174, for example using a self-tapping screw. Similar to the assembly rod 174, the self-tapping screw can be inserted into the second aligned apertures 122*a*, 122*b* of the second framing member, but then the self-tapping screw is aligned with the third groove 146 instead of either of first or second grooves 144*a*, 144*b*. As mentioned above, the third groove 146 may have a smaller diameter than the first or second grooves 144*a*, 144*b*. The smaller diameter generally allows the self-tapping screw to thread into the third grove 146 while being screwed in, whereas the first and second grooves 144*a*, 144*b* generally have a larger diameter that may be larger than the threads of the self-tapping screw.

Figure 17:
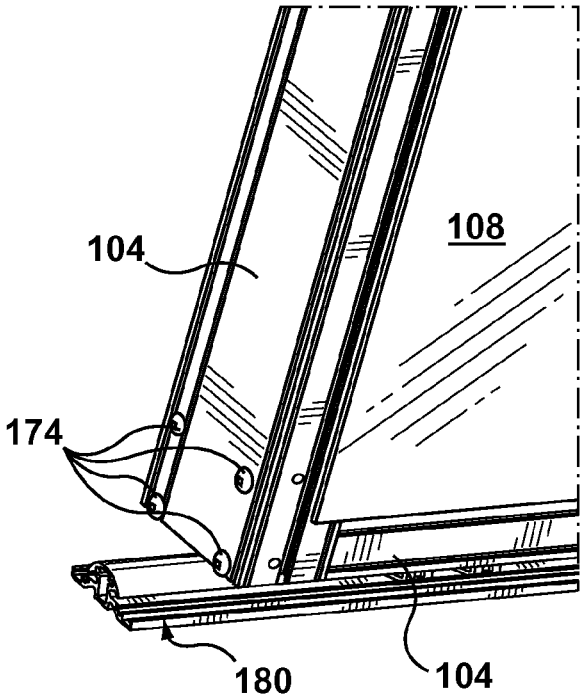
FIG. 17 is a perspective view of a joint between two second framing members using assembly rods.
Figure 18:
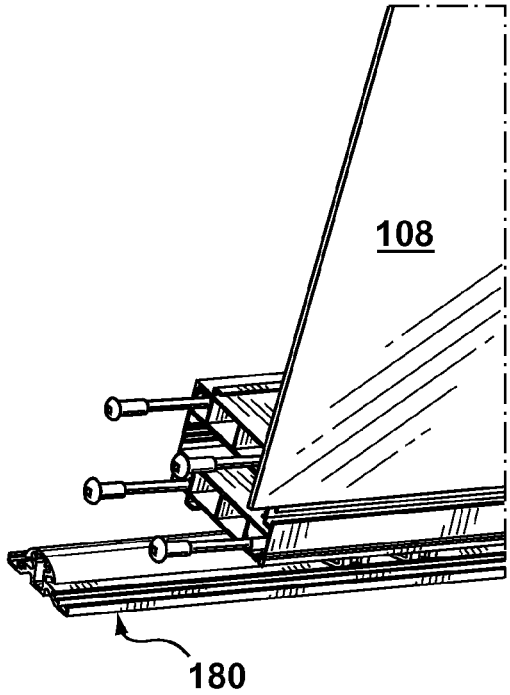
FIG. 18 is a perspective view of the joint shown in FIG. 17 with one of the second framing members removed.
Figure 19:
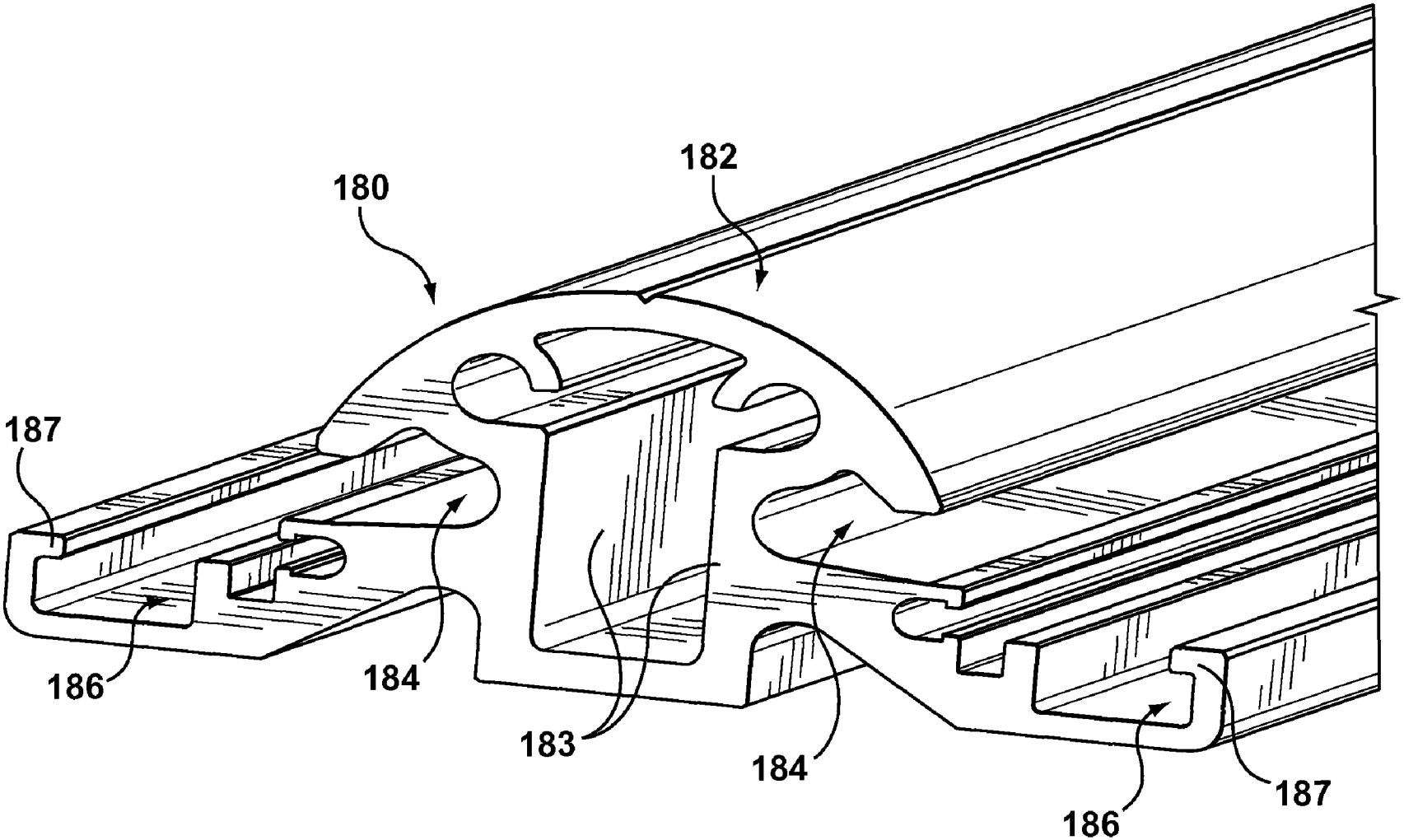
FIG. 19 is a perspective view of a cross-section of a track for supporting moveable bays of the retractable enclosure.

In some examples, the first and second joints may join with one second framing member 104 at each end of the first framing member 106, as opposed to joining two second framing members 104*a*, 104*b* at the end of each first framing member 106. An example of this configuration is when the first framing member acts as a brace or spacer between two parallel second framing members. In other examples, the first framing member may be replaced by another second framing member, for example at the base of a sidewall of the retractable enclosure 100 (as shown in FIGS. 17 and 18). In these examples, the assembly rod 174 may be inserted through one of the grooves 120 within the third second framing member. Furthermore, the joint between two perpendicular second framing members may be strengthened by using more than one assembly rod 174, for example using four assembly rods as illustrated.

Figure 13:
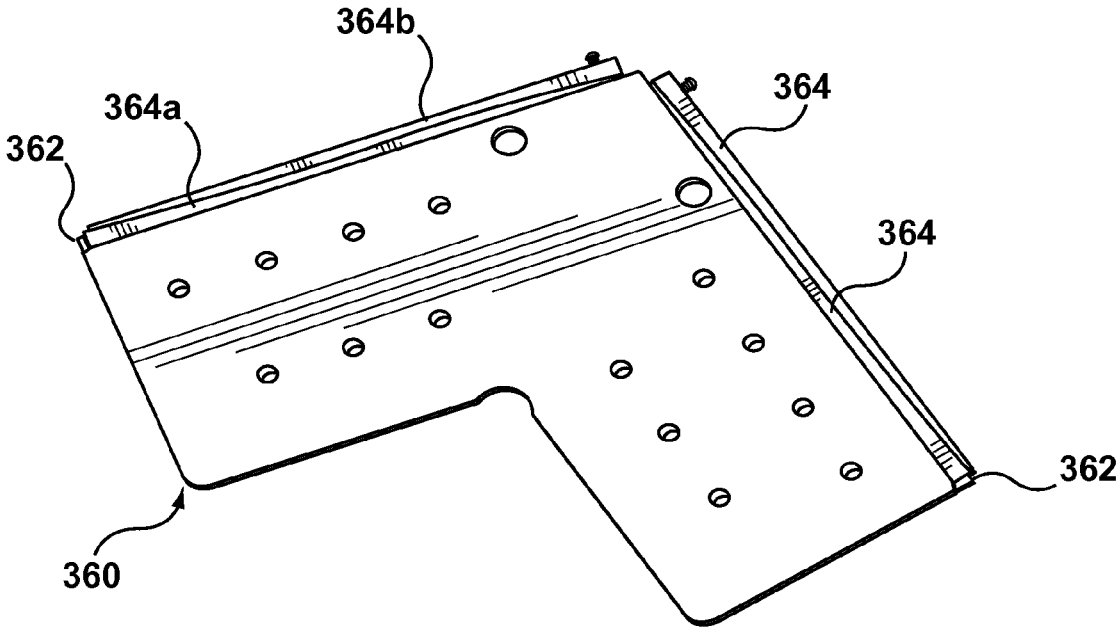
FIG. 13 is a perspective view of wedges and a third splice plate.
Figure 14:
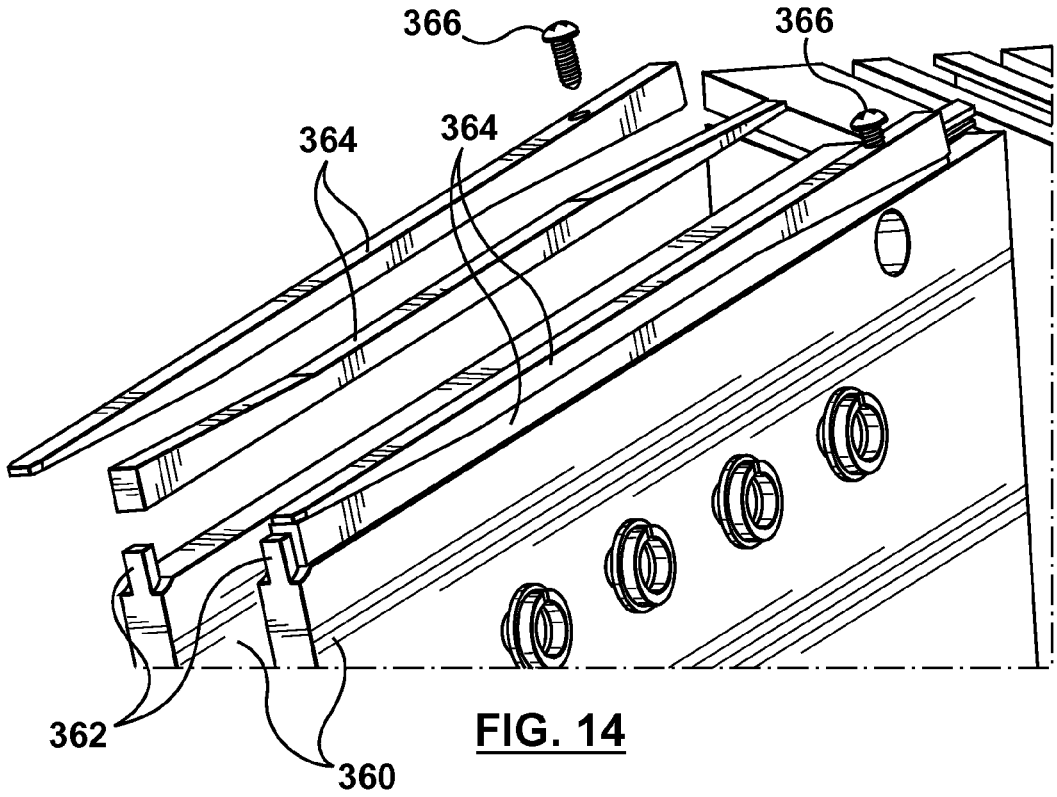
FIG. 14 is another perspective view of the wedges and the third splice plate.

In some examples, splice plates can be secured within the slots of the framing members. Referring to FIGS. 13 and 14, a splice plate 360 is similar to splice plates 160 and 260, but further includes tabs 362. The splice plate 360 is used with wedges 364 to lock the splice plate 360 into position within the framing members. In some examples, the wedges 364 can be formed of aluminium and have a generally triangular shaped cross-section. Inner and outer wedges 364*a*, 364*b* can be slidably mounted along edges of the splice plate 360, and securable to the splice plate 360 with one or more fasteners 366. The fasteners 366 can be, for example but not limited to, self-tapping screws. The inner wedge 364*a* abuts the tab 362, which is located at an end of the splice plate 360. The tab 362 prevents the inner wedge 364*a* from moving out of position when the outer wedge 364*b* is set in position.

Figure 15:
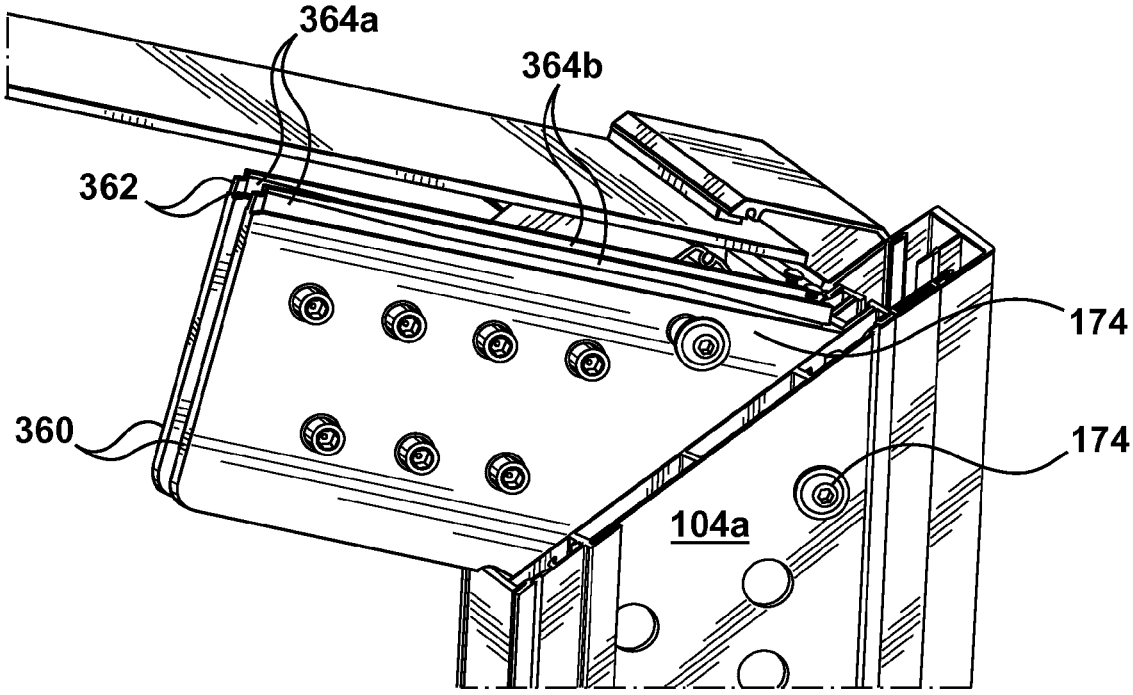
FIG. 15 is a perspective view of the joint illustrated at point B in FIG. 1, wherein one of the second framing members is removed to expose the third splice plate.
Figure 16:
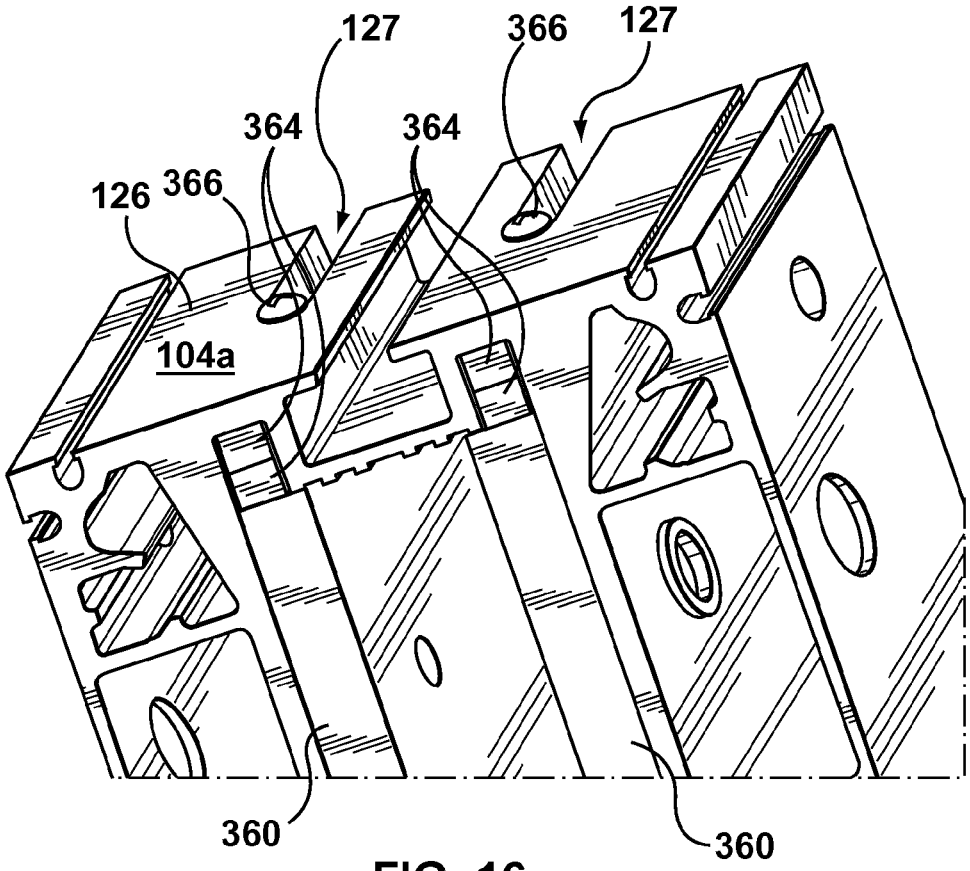
FIG. 16 is a sectional view of the third splice plate with wedges secured to a second framing member.

Referring to FIGS. 15 and 16, as with splice plates 160 and 260, splice plate 360 may be implemented to reinforce a joint where the angle between framing members changes. For example, as illustrated the second framing member 104 can be jointed with another member 104 (not shown) utilizing two splice plates 360, four sets of wedges 364, and four fasteners 366. To assemble the joint, each set of wedges 364 are placed along top edges of the splice plates 360 (see FIG. 14). Once the second framing member 104 and the splice plate 360 are positioned and secured with assembly rod 174, the outer wedge 364*b* can be mechanically forced (for example, using a hammer) towards the tab 362 of the splice plate. Access to the outer wedge 364*b* can be obtained through cutouts 127 provided on the top surface 126 of the second framing member 104. The cutouts 127 need only to be provided on the top surface 126 of the second framing member 104 adjacent to the joint. With the inner wedge 364*a* abutting the tab 362, movement of the outer wedge 364*b* toward the tab 362 jams the splice plate within the slot of the second framing member 104. The wedges 364 can then be locked into position using the fasteners 366.

Referring to FIGS. 17 to 20, each bay moves along a pair of tracks 180 that are parallel and laterally spaced apart from one another. Generally, the tracks 180 are elongate structural members and may be made from a similar material as the framing members 104, 106. Furthermore, the tracks 180 may be formed by extrusion. The profile of each track 180 generally has a top surface 182 supported by a web 183. The shape of the top surface is generally semi-circular and convex. The track 180 may also have two hollow guide slots 184, one below each edge of the top surface 182. As illustrated, the interior profile of the guide slots 184 may be generally reniform. The web 183 of the track extends downward below the guide slots 184 and branches laterally outward to form two laterally opposing cable grooves 186. As illustrated, the cable grooves have a hollow opening facing upward, which may be rectangular in shape. The outermost edge of the cable groove 186 may include a lip 187 that overhangs a portion of the hollow opening.

Each track 180 extends underneath a sidewall of a bay 102 from a point where the bay 102 is fully extended to a point where the bay 102 is fully retracted. Generally, each track 180 is secured to the ground. In some examples, a track may extend the full length of the retractable enclosure. For example, the track that supports the end bay 102*a* may extend the full length of the retractable enclosure 100 such that the end bay can move along the track from a fully retractable position to a fully extended position.

Figure 20:
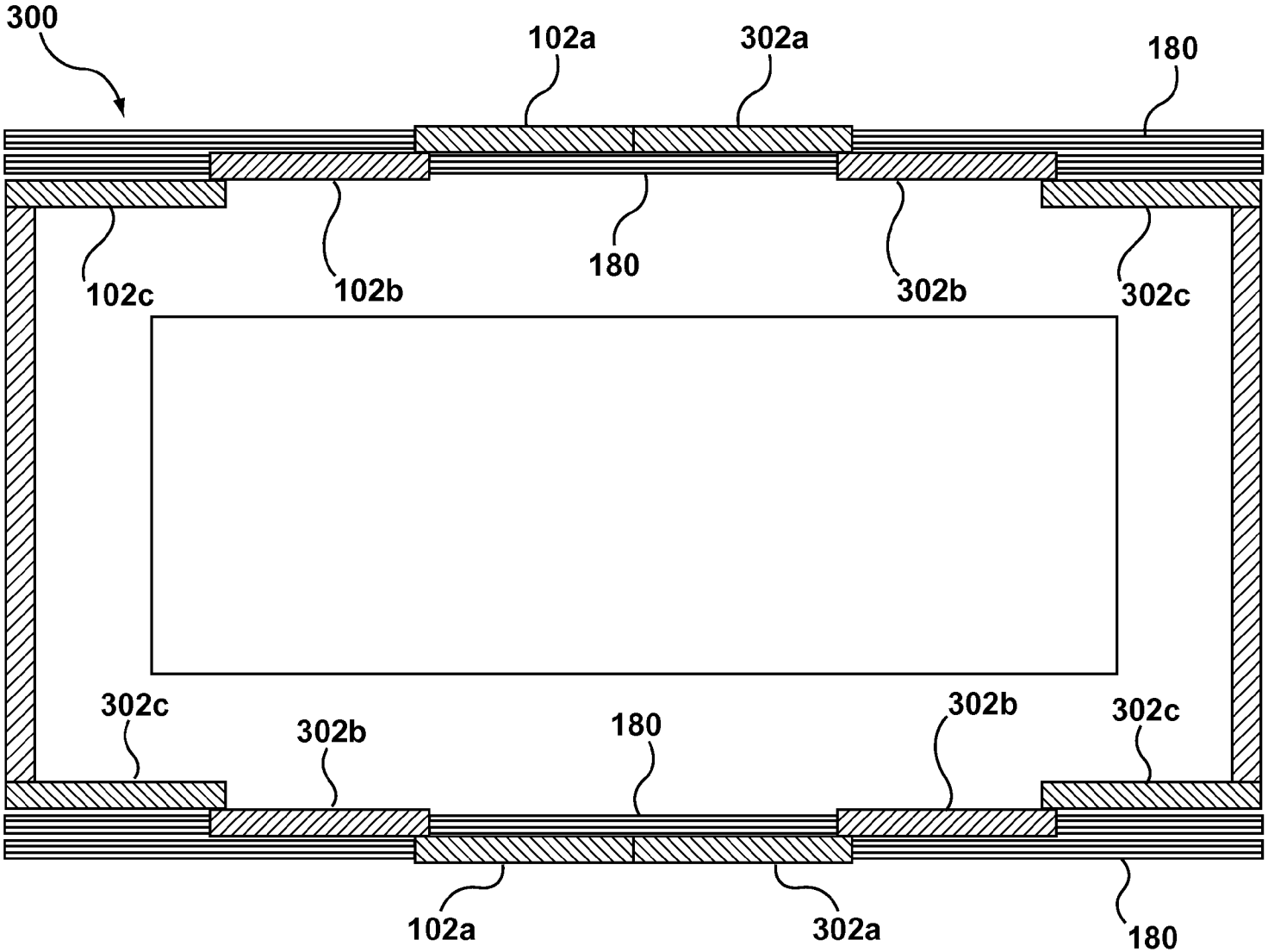
FIG. 20 is a top view of a retractable enclosure that opens from the middle.

In some examples, such as the retractable enclosure 300 illustrated in FIG. 20, the bays may open and close from the middle of the retractable enclosure. Accordingly, the end bay 102*a* may abut with a corresponding end bay 302*a* such that the bays open and close from the middle of the retractable enclosure 300. In these examples, each track 180 may extend the whole length of the retractable enclosure. This allows each track to support two bays, one bay on each side of the middle of the retractable enclosure 100. For example, the two end bays 102*a*, 302*a* may share the same track, and the two other moveable bays 102*b*, 302*b* may share a track.

Figure 21:
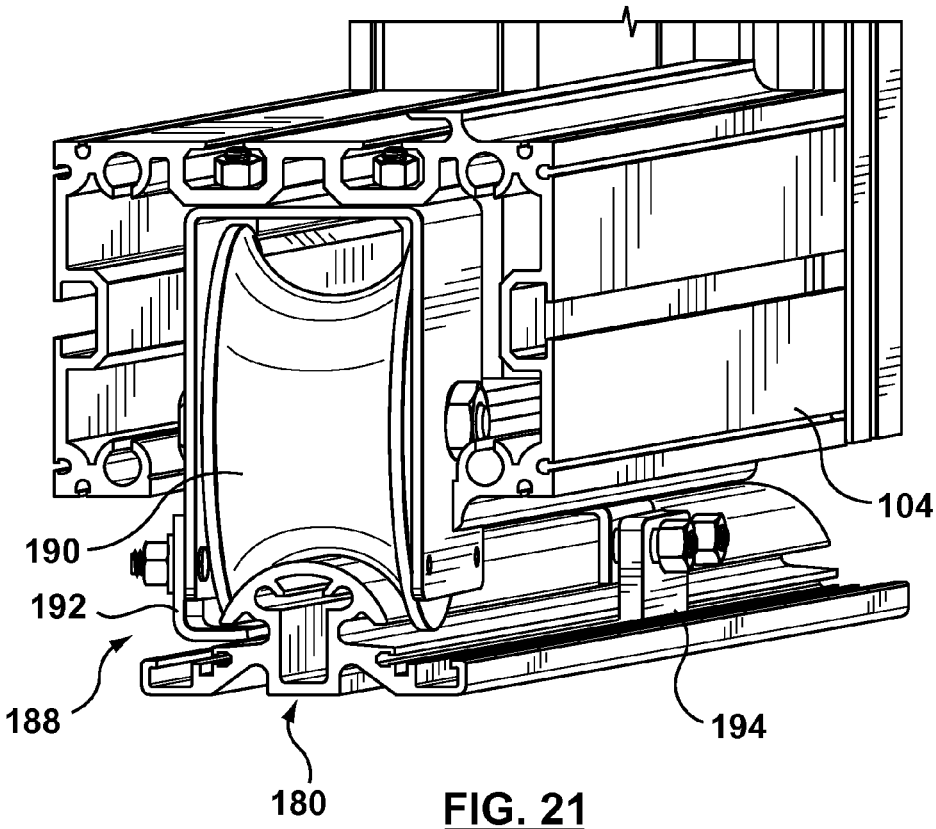
FIG. 21 is a perspective view of a wheel assembly affixed to the bottom of a bay and mounted to a track.
Figure 22:
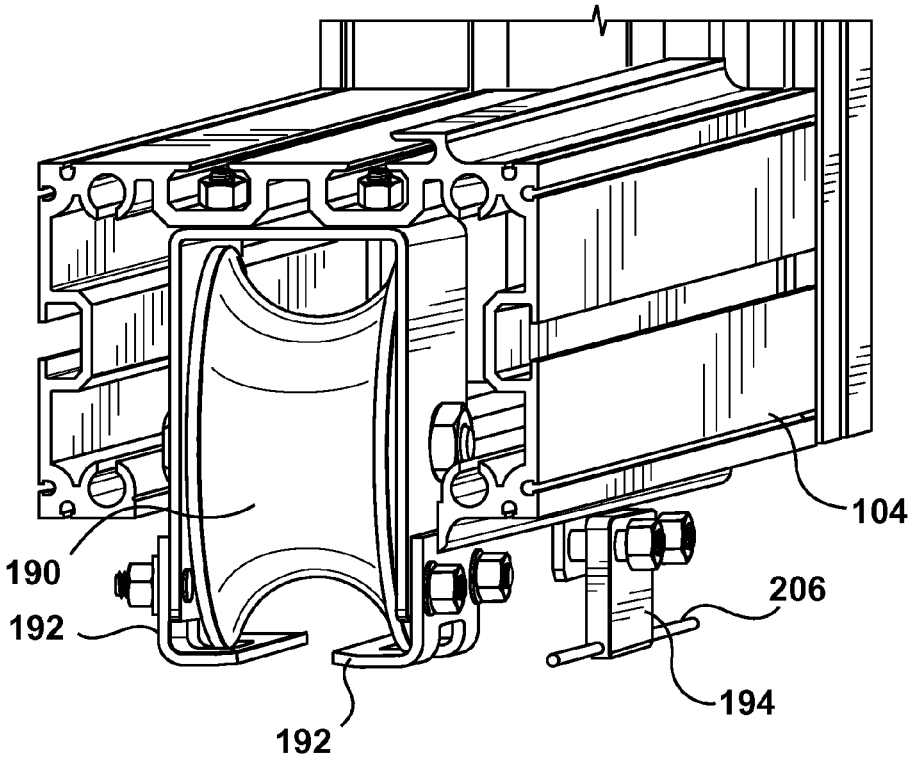
FIG. 22 is a perspective view of the wheel assembly shown in FIG. 21, wherein the track is removed.
Figure 23:
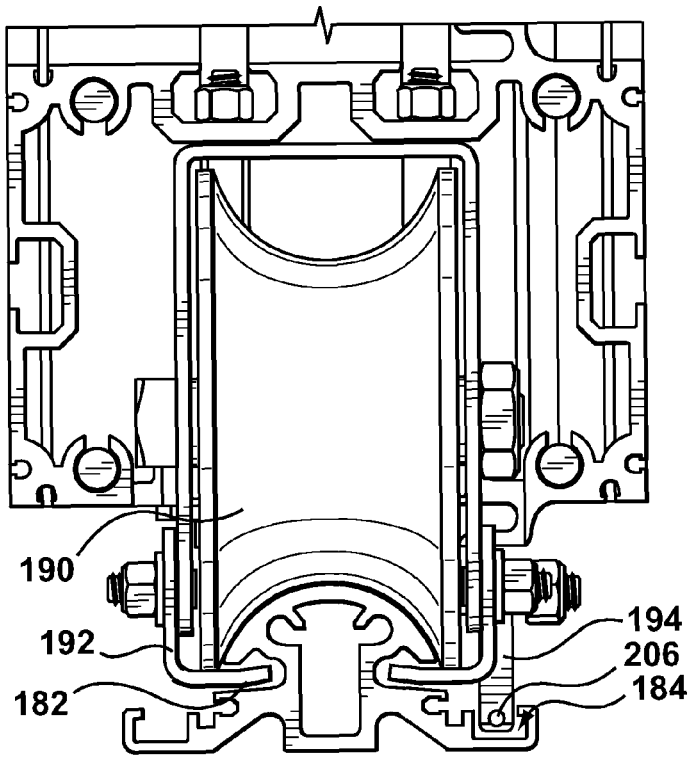
FIG. 23 is a cross-sectional front view of the wheel assembly and track shown in FIG. 21.

Referring to FIGS. 21 to 23, each bay 102 may include wheel assemblies 188 affixed to the bottom of the bay 102. The wheel assemblies 188 mount to the track 180 and allow movement of the moveable bays 102 along the track 180. For example, there may be two wheel assemblies 188 affixed to the lower second framing member 104 extending along the base of each side of the bay 102. As illustrated, one of the sidewalls of the second framing member 104 may be removed to affix the wheel assembly 188 within the second framing member 104, for example using fasteners such as bolts. The wheel assembly 188 includes a wheel 190 having a concave outer surface that corresponds to the convex top surface 182 of the track 180. The shapes of the wheels 190 and the convex top surface 182 of the track 180 cooperate to allow longitudinal movement of the bay 102 along the track 180, while inhibiting lateral movement of the bay 102.

The wheel assemblies 188 may also include keeper plates 192, which may be L-shaped brackets that extend down below the wheel 190 and project inward. The inward projections of the keeper plates are generally received within the guide slots 184 of the track 180. The keeper plates 192 and guide slots 184 are intended to cooperate in order to reduce vertical movement of the bay 102. For example, if a wind were to cause the bay to pull upward off the tracks 180, the keeper plate 192 would bump into the lower interior surface of the guide slots 186 and thereby inhibit vertical movement of the bay. The keeper plates 192 and guide slots may also reduce vertical movement in other situations, for example while retracting and extending the bay 102. The wheel assembly 188 of the end bay 102*a* may also include a cable bar 194 that connects to a cable that is part of a drive system, which will be described in further detail below. The cable bar 194 generally extends downward below the wheel 190 and the keeper plates 192, and may be configured to float within the cable groove 186 of the track 180. In some examples, the cable groove 186 may be covered with a flexible rubber seal that is intended to keep dirt and other debris out of the cable groove 186 while also permitting the cable bar 194 to move along the cable groove 186. In some examples, the cable bar 194 may be removably fastenable to the framing members 104 using fasteners, such as bolts.

Figure 24:
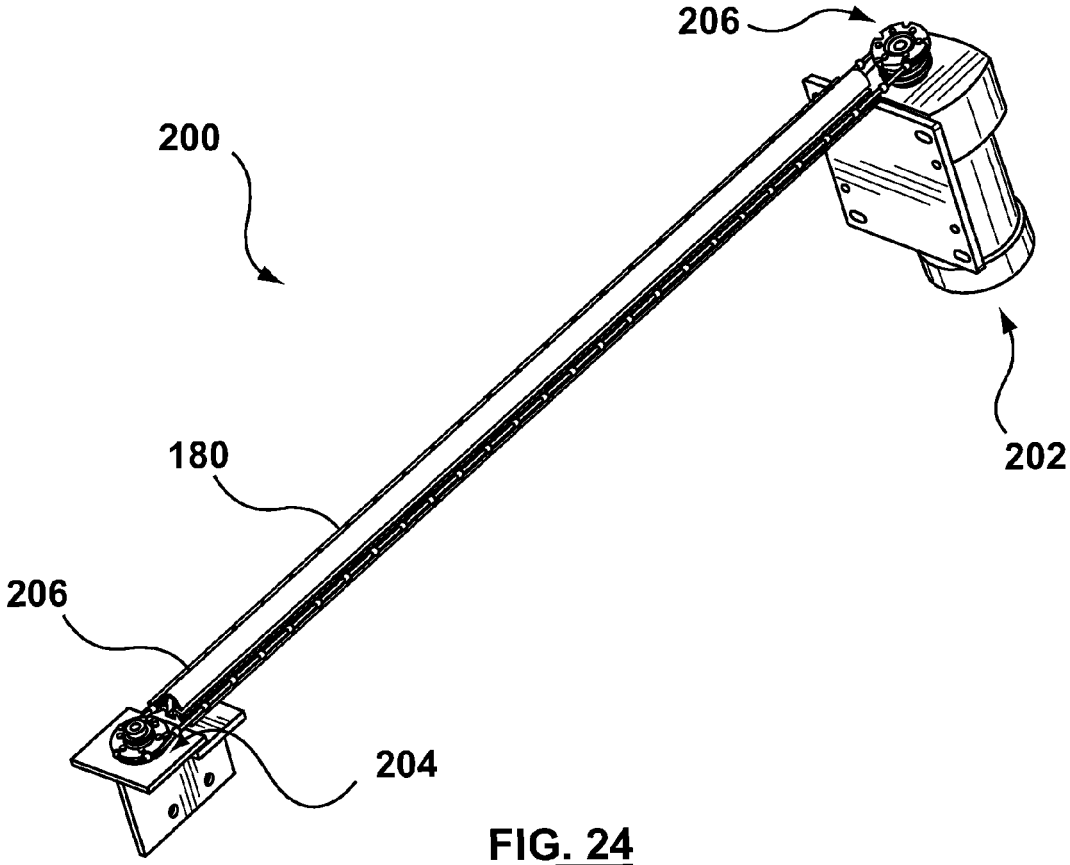
FIG. 24 is a perspective view of a drive system for moving the bays of the retractable enclosure.
Figure 25:
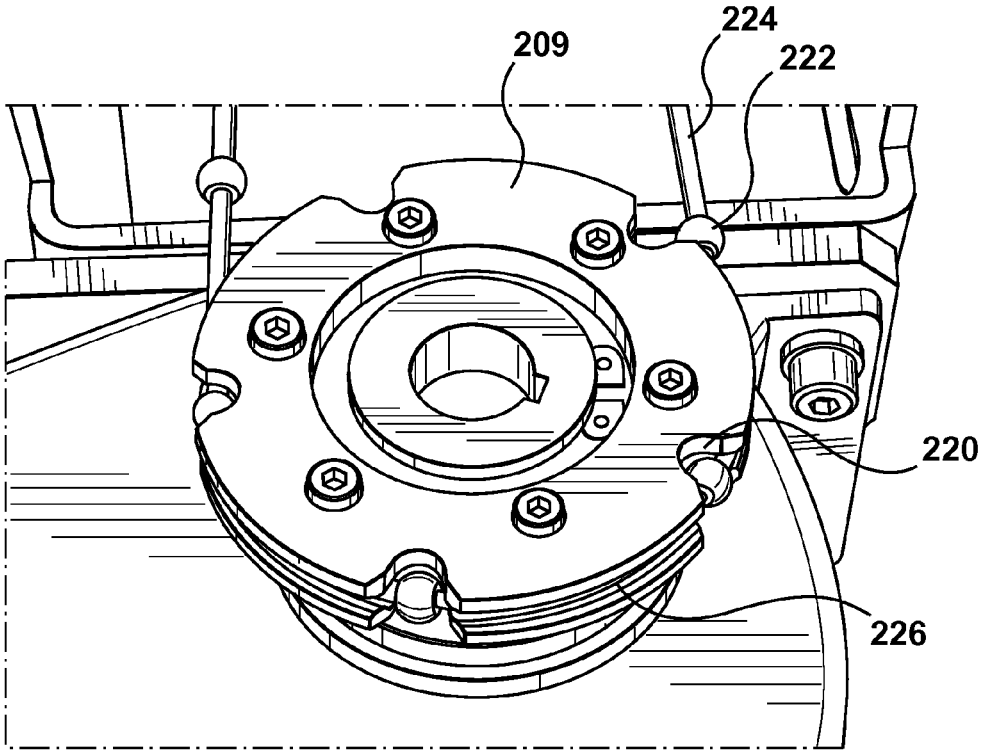
FIG. 25 is a perspective view of a sprocket drive pulley and cable.

Referring now to FIG. 24, there is a drive system 200 for retracting and extending the bays 102 along the track 180. The drive system 200 may generally include a motor assembly 202, a return pulley 204 and an endless cable 206. The motor assembly 202 can be an electric motor and include a gear box. The motor assembly 202 is generally located at a proximal end of the track that supports the end bay 102*a*. The pulley 204 is located at a distal end of the same track and may be a wheel, cylindrical rod or any other type of pulley. The motor assembly 202 and return pulley 204 may be affixed to the ground, or the track to secure them in place. The endless cable 206 is rotatably connected to the motor assembly 202 and the return pulley 204 such that, operation of the motor assembly 202 circulates the endless cable 206 around the return pulley 204.

In some examples, the motor assembly 202 can include a drive pulley 208 connected to the endless cable 206. In such examples, operation of the motor assembly 202 may include activating a clutch that is connecting the output of the motor assembly 202 to the drive pulley 208, which then circulates the endless cable 206.

As illustrated in FIGS. 21 to 23, the endless cable 206 is also connected to the cable bar 194, which is affixed to the end bay 102*a* via the wheel assembly 188. In the example illustrated in FIGS. 21 and 23, the cable bar 194 extends downward from the framing members 104 such that it attaches to the endless cable 206 at a point within the cable grooves 186 of track 180. This configuration tends to keep the endless cable 206 in a position that is concealed and out-of-the-way from people walking around the retractable enclosure 100.

In operation, circulation of the endless cable 206 moves the end bay 102*a* due to interconnection with the cable bar 194. Depending on the direction of circulation, either clockwise or counter-clockwise, the end bay 102*a* will either retract or extend. In some examples, such as the one shown in FIG. 20, the endless cable 206 may be connected to two bays. For example, the endless cable 206 may be connected to the two end bays 102*a*, 302*a*. In these examples, the first end bay 302*a* may have a wheel assembly with a cable bar that attaches to a portion of the endless cable 206 that resides on one edge of the track 180. Conversely, the second end bay 302*a* may have a wheel assembly with a cable bar that attaches to a portion of the endless cable 206 that resides on the opposite edge of the track 180. Thus, as the endless cables circulate, the cable bars will move in opposite direction, which will simultaneously retract or extend the end bays 102*a*, 302*a*.

Referring to FIGS. 25 to 30, in some examples of the drive system 200, the drive pulley 208 of the motor assembly may comprise a sprocket drive pulley 209 having recesses 220 configured to drive an endless cable 207. The endless cable 207 comprises positive engagement elements 222 secured in a spaced apart manner along a cable 224. The recesses 222 of the sprocket drive pulley 209 accept the positive engagement elements 222 sufficiently to allow force to be applied to the cable 224. This means of transferring load can allow for the full strength of the cable 224 to be directed to the pulling of the end bay 102*a*, and prevents slipping of the endless cable 207 when powered by the sprocket drive pulley 209 when minimal tension is applied.

Figure 26:
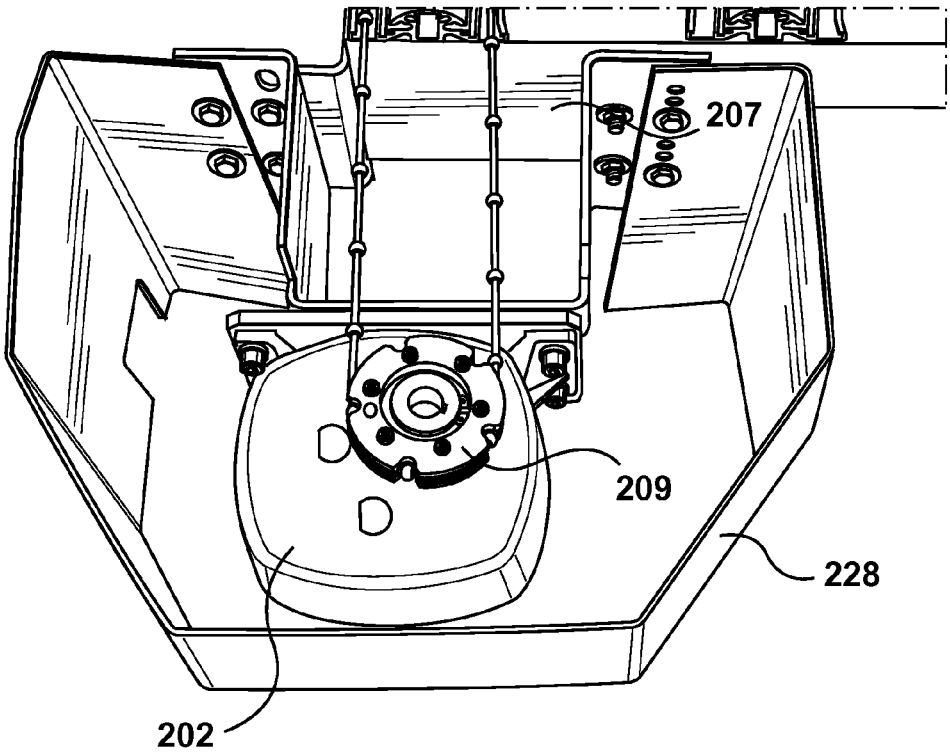
FIG. 26 is a further perspective view of the sprocket drive pulley and cable of FIG. 25.
Figure 27:
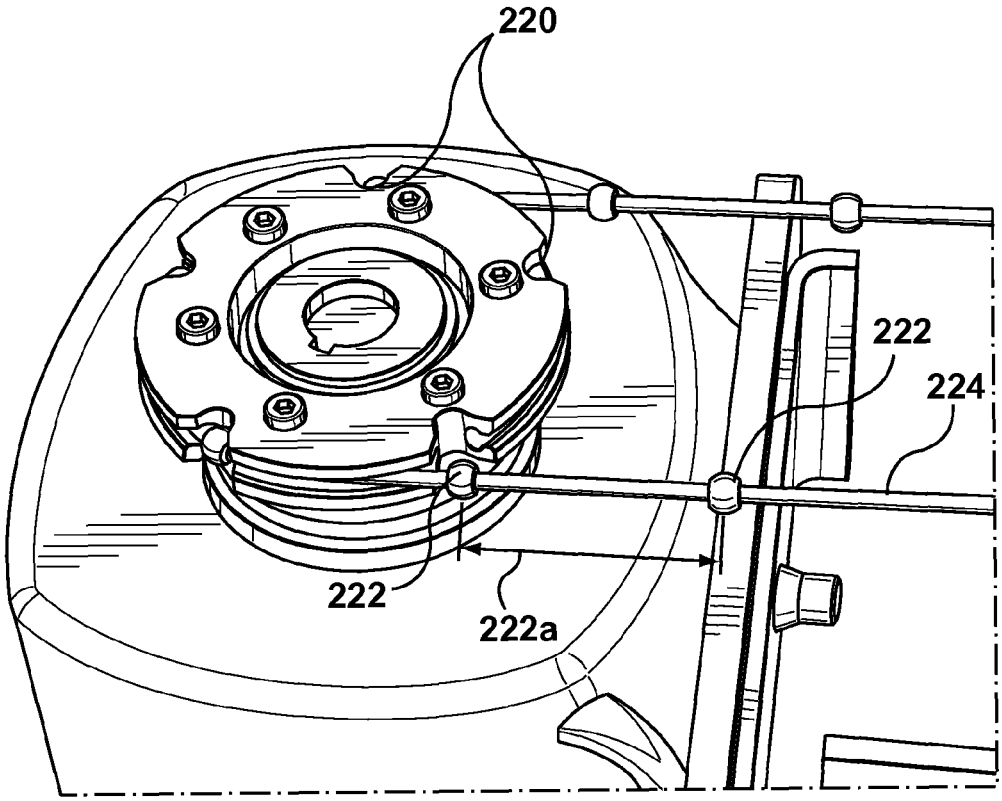
FIG. 27 is a further perspective view of the sprocket drive pulley and cable of FIG. 25.
Figure 28:
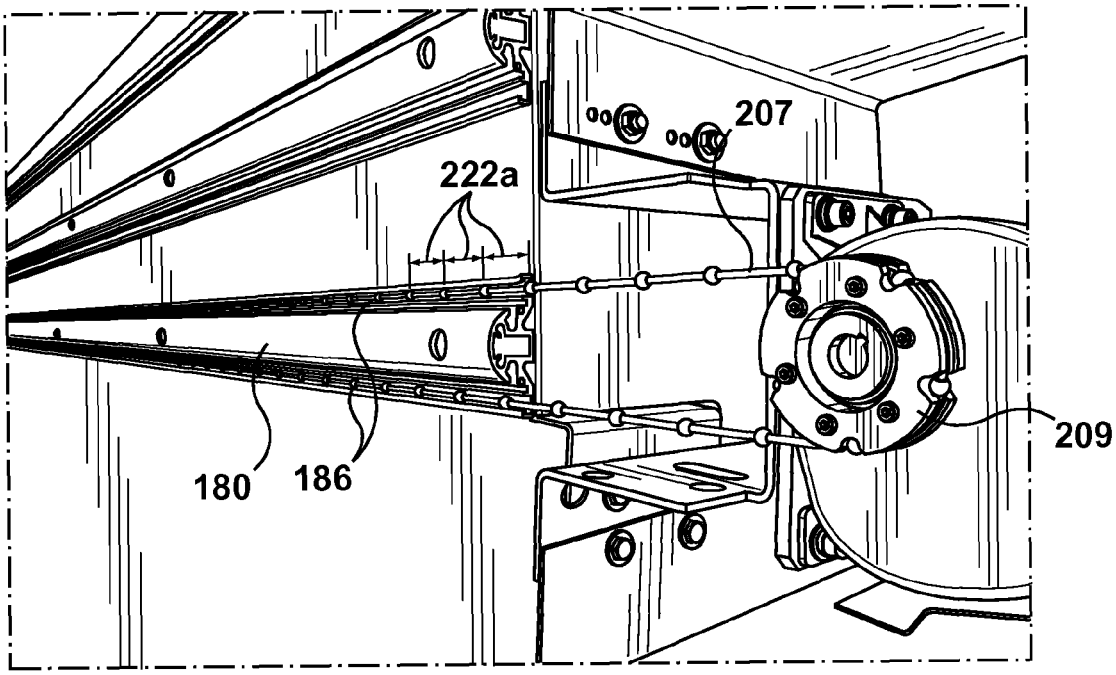
FIG. 28 is a further perspective view of the sprocket drive pulley and cable of FIG. 25, shown with a track.
Figure 29:
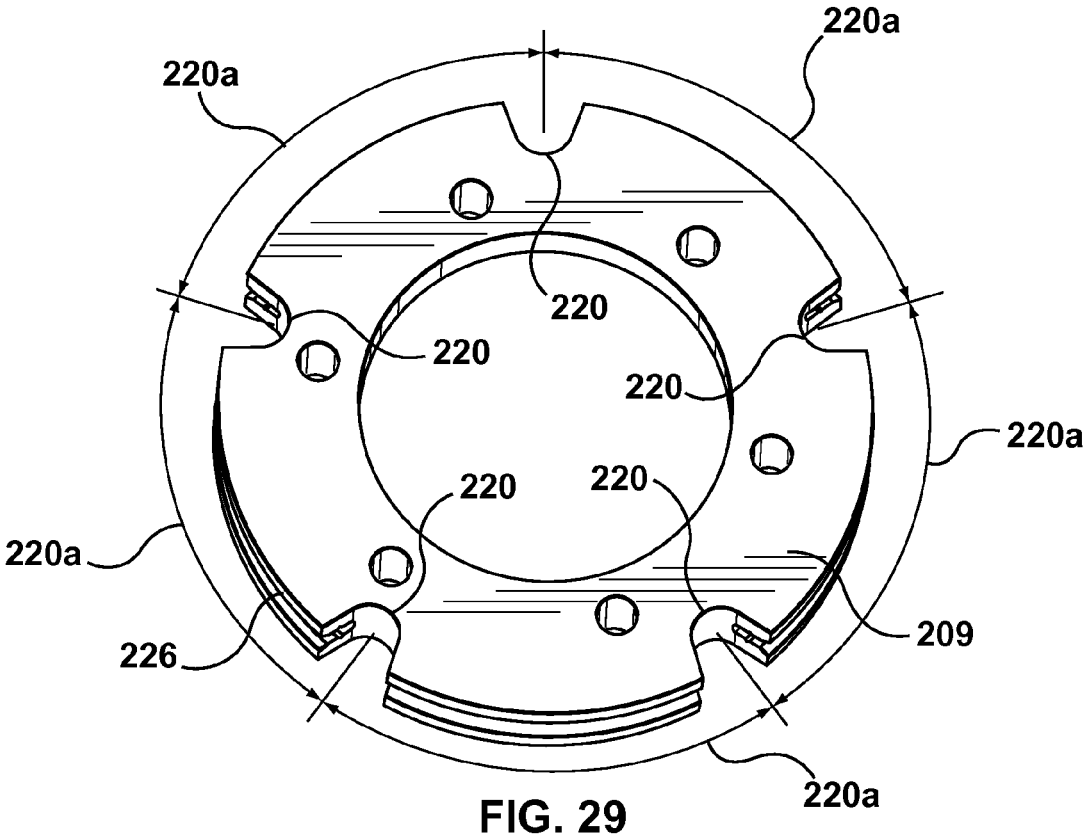
FIG. 29 is a top perspective view of the sprocket drive pulley.
Figure 30:
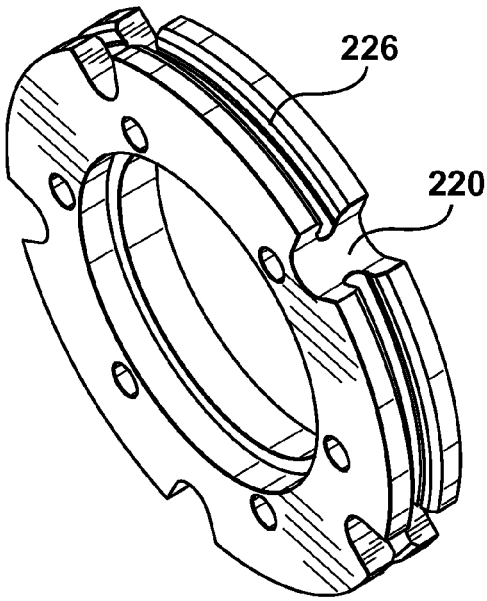
FIG. 30 is a side perspective view of the sprocket drive pulley.

The positive engagement elements 222 can comprise beads or balls fixed securely at specific locations to the cable 224. Adjacent beads 222 can be spaced apart from each other by a constant pitch 222*a*. The sprocket drive pulley 209 can be a circular disc with a centre groove 226 extending radially inwardly from outer axial surface, the centre groove 226 sized to receive the cable 224 of the endless cable 207. The outer circumference of the sprocket drive pulley 209 comprises the recesses 220 aligned to receive the beads 222 of the endless cable 207. The circumferential spacing 220*a* of the recesses 220 around the outer diameter of the sprocket drive pulley 209 is equal to the pitch 222*a* by which the beads 222 are spaced apart along the cable 224. In the example illustrated, the beads 222 are sized to fit within the guide slots 186 of the track 180. Adequate spacing 220*a* and 222*a* can also ensure that fretting of the cable 224 due to bending around the sprocket drive pulley 209 is reduced or eliminated. The sprocket drive pulley 209 and the motor assembly 202 may be provided within a housing 228 to keep dirt and other debris out of the drive system (FIG. 26).

In some examples, there may be two drive systems connected to a single end bay 102. In particular, each of the two drive systems may be associated with the track below each sidewall of the end bay 102*a*. In these examples, the drive systems connect to separate wheel assemblies through cable bars, but the drive systems cooperate to move the end bay 102*a*. In particular, when the drive systems circulate their respective endless cables, the cable bars will cooperatively move in the same direction. Using two drive systems can improve the smooth movement of the end bay 102*a* and prevent buckling of the end bay 102*a* with respect to other bays or the tracks.

In some other examples there may be one drive system, where the endless cable 206 circulates through a cable groove of one track, and then around the pulley 204 (or pulleys), and then through a cable groove of the other parallel track.

Figure 32:
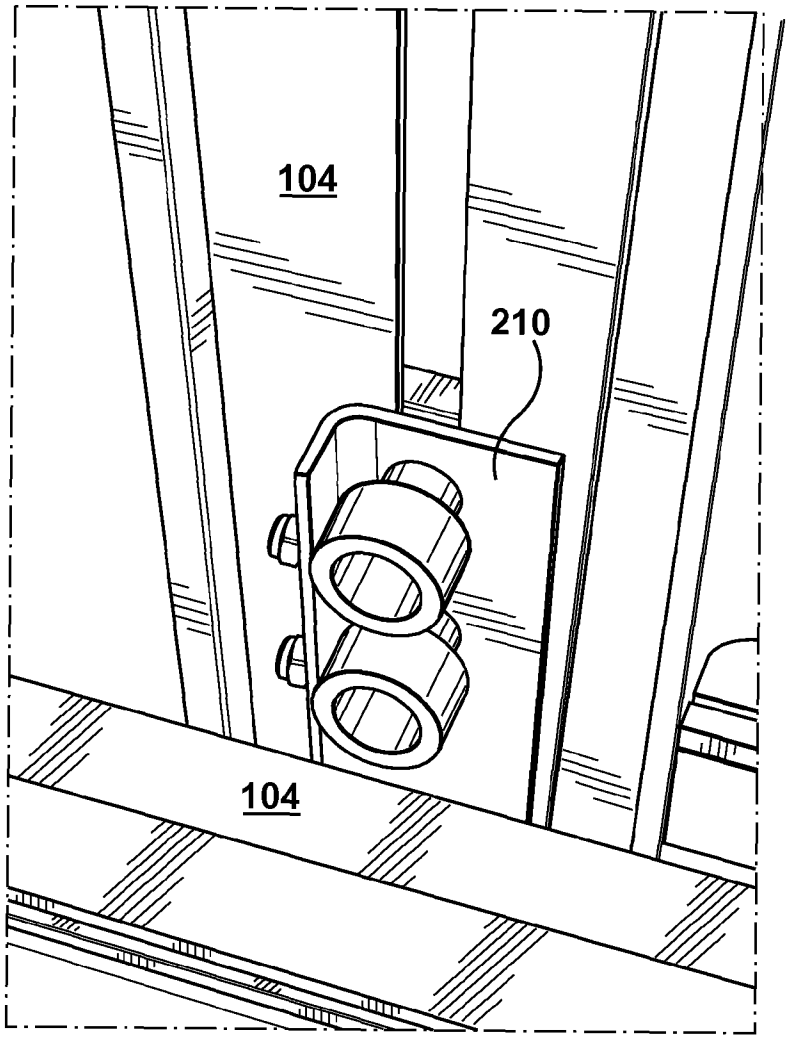
FIG. 32 is an elevated perspective view of the bumper shown in FIG. 31.
Figure 31:
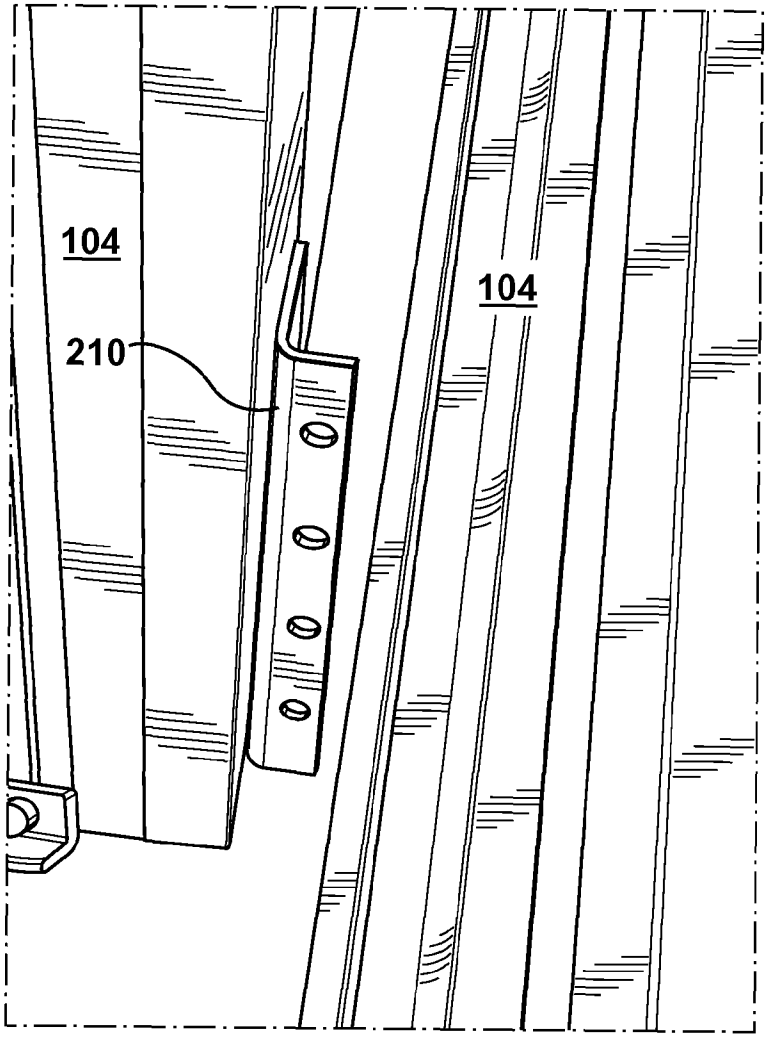
FIG. 31 is a perspective view of a bumper attached to a bay.

Referring to FIGS. 31 and 32, in some examples, the retractable enclosure may also include bumpers 210. The bumpers 210 may be attached to each of the moveable bays such that when the drive system moves the end bay 102*a*, the bumpers 210 on the moveable bays abut adjacent bays and pull the adjacent bays in the same direction as the end bay 102*a*. Similarly, bumpers on the adjacent bay may pull other adjacent bays with the end bay 102*a*. As illustrated, the bumpers may include a right-angled bracket. The bracket may attach to the sidewall of the bay such that an edge of the bracket projects away from the sidewall. The projecting edge may then abut the adjacent bays allowing movement with the end bay 102*a*. The projecting edge may also include a damper, for example a piece of rubber. The damper may reduce vibration when the bays abut one another. In some examples, the retractable enclosure may include both inner bumpers 210 and outer bumpers 210. The inner and outer bumpers 210 may alternatively engage an adjacent bay to pull the respective bay with the adjacent bay while either retracting or extending the retractable enclosure 100.

In the examples described above, preloading the framing members 104, 106 with the assembly rod 174 may be helpful in situations where the retractable enclosure 100 is used in windy environments. Winds may otherwise cause the framing members to buckle, thereby twisting the overall frame of the bay 102. Such twisting can affect smooth operation of the drive system, and in some cases may cause overloading of the motor, jamming of the bay along the track, or otherwise inhibiting movement of the bays 102.

Providing a retractable enclosure according to the examples described herein, or variations thereof, can allow the construction of a modular retractable enclosure. For example, the retractable enclosure can be built in a variety of sizes by cutting the second framing member 104 and first framing members 106 to different lengths. Accordingly, the width, length and height of the retractable enclosure can be varied. The modular retractable enclosures can also have different roof configurations. For example, the roof can be a single peak, double peak, triple peak, or any other configuration depending on the number and type of splice plates used to join the second framing members of the various roof sections. In examples where the roof sections have large spans, assembly rods can be used to strengthen the retractable enclosure. Furthermore, the modularity can allow variation on the number of bays, and also the configuration of bays with respect to each other. For example, the retractable enclosure may be configured such that the bays open from the middle of the retractable enclosure, or the end of the retractable enclosure. Furthermore, the bays can either retract one over another, or one under another.

While the above description provides examples of one or more processes or apparatuses, it will be appreciated that other processes or apparatuses may be within the scope of the accompanying claims.

I claim:

1. A retractable enclosure comprising two or more bays configured to telescopically overlap when in a retracted position, each of the two or more bays comprising:

at least a first vertical framing section and a second vertical framing section;

a plurality of first framing members disposed between the first vertical framing section and the second vertical framing section to space apart the first vertical framing section from the second vertical framing section; and a plurality of assembly rods coupling the first vertical framing section with the second vertical framing section, wherein each of the assembly rods fastens a respective one of the first framing members between the first vertical framing section and the second vertical framing section, and wherein each of the assembly rods is tensioned to load the plurality of first framing members in longitudinal compression.

2. The retractable enclosure of claim 1, wherein the first framing members are generally horizontal.

3. The retractable enclosure of claim 1, wherein the first framing members have a generally uniform longitudinal cross-section.

4. The retractable enclosure of claim 3, wherein the first framing members comprise longitudinal channels for retaining the assembly rods.

5. The retractable enclosure of claim 4, wherein the first vertical framing section and the second vertical framing section include apertures for receiving ends of the assembly rods.

6. The retractable enclosure of claim 1, further comprising clamping elements coupled to at least one end of each of the assembly rods to engage the first vertical frame section and exert force urging the first vertical frame section toward the second vertical frame section.

7. The retractable enclosure of claim 6, wherein the clamping elements are adjustable.

8. The retractable enclosure of claim 1, wherein each of the vertical framing sections comprises a plurality of second framing members.

9. The retractable enclosure of claim 8, wherein the second framing members have a second generally uniform longitudinal cross-section.

10. The retractable enclosure of claim 8, wherein adjacent second framing members in each vertical framing section are coupled by splice plates.

11. The retractable enclosure of claim 10, wherein the second framing members include slots at each end for receiving the splice plates, and wherein the splice plates are secured within the slots using wedges.

12. The retractable enclosure of claim 10, wherein the second framing members include first apertures, and the splice plates include second apertures aligned with the first apertures, and the first and second apertures receive ends of the assembly rods.

13. The retractable enclosure of claim 1, further comprising tracks supporting a first bay of the two or more bays and enabling movement of the first bay between the retracted position and an extended position.

14. The retractable enclosure of claim 13, further comprising a drive system for moving the first bay along the tracks between the retracted and extended positions.

15. The retractable enclosure of claim 14, wherein the drive system comprises:

a motor assembly including a motor and a drive pulley, the drive pulley provided proximate to a first position on the tracks;

at least one return pulley provided proximate to a second position on the tracks spaced apart from the first position; and a cable linking the drive and return pulleys, the cable coupled to the first bay, wherein operation of the motor assembly circulates the cable between the drive and return pulleys causing the first bay to move along the tracks between the first and second positions.

16. The retractable enclosure of claim 15, wherein the first bay comprises a plurality of wheel assemblies, the wheel assemblies movably connecting the first bay to the tracks.

17. The retractable enclosure of claim 16, wherein at least one of the plurality of wheel assemblies is coupled to the cable.

18. The retractable enclosure of claim 15, further comprising a plurality of engagement elements secured spaced apart along the cable, and wherein the drive pulley comprises a sprocket drive pulley having a plurality of recesses spaced around its circumference, the recesses configured to receive the engagement elements.

19. A method of constructing a retractable enclosure, comprising:

constructing a bay, comprising the steps of providing a plurality of first framing members, a plurality of second framing members, and a plurality of assembly rods, joining the plurality of second framing members together to form a first vertical framing section and a second vertical framing section, placing the plurality of first framing members between the first vertical framing section and the second vertical framing section so that the vertical framing sections maintain a spaced apart relationship, fastening the first framing members to the first vertical framing section and the second vertical framing section with the plurality of assembly rods, and tensioning the plurality of assembly rods to load the plurality of first framing members in longitudinal compression; and repeating the step of constructing to form two or more bays, wherein the two or more bays are configured to telescopically overlap when in a retracted position.

20. The method of claim 19, further comprising placing at least one of the two or more bays on parallel tracks enabling movement between the retracted position and an extended position.

21. The method of claim 19, further comprising inserting panels to enclose space within each of the two or more bays.

22. A retractable enclosure comprising two or more bays configured to telescopically overlap when in a retracted position, each of the two or more bays comprising:

a plurality of framing members joined together to form first and second vertical framing sections;

a plurality of horizontal framing members arranged between the vertical framing sections to space apart the first vertical framing section from the second vertical framing section, each of the horizontal framing members comprising a longitudinal channel; and a plurality of assembly rods, each of the assembly rods being received in the longitudinal channel of a respective one of the horizontal framing members and having a first end connected to a respective one of the framing members of the first vertical framing section and a second end connected to a respective one of the framing members of the second vertical framing section, so as to fasten the respective one of the horizontal framing members between the first and second vertical framing sections, wherein the assembly rods are tensioned to load the horizontal framing members in longitudinal compression between the first and second vertical framing sections.

* * * * *